US010553063B2

(12) United States Patent
Shibata et al.

(10) Patent No.: US 10,553,063 B2
(45) Date of Patent: Feb. 4, 2020

(54) COIN VALIDATION DEVICE

(71) Applicant: FUJI ELECTRIC CO., LTD., Kawasaki-shi, Kanagawa (JP)

(72) Inventors: Yoshito Shibata, Tsu (JP); Kazuhiro Tomita, Yokkaichi (JP); Takeshi Oiwa, Ueda (JP); Takuya Yamane, Yokkaichi (JP); Masashi Nagata, Yokkaichi (JP); Yoshiyuki Fukushima, Yokkaichi (JP); Takao Okuhara, Yokkaichi (JP); Yoshihiro Taniguchi, Yokkaichi (JP); Masao Nakayama, Yokkaichi (JP); Shojiro Onzuka, Yokkaichi (JP); Takuya Fukuura, Yokkaichi (JP); Shunsuke Kowase, Yokkaichi (JP); Tsuyoshi Horiguchi, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 9 days.

(21) Appl. No.: 15/800,796

(22) Filed: Nov. 1, 2017

(65) Prior Publication Data

US 2018/0151015 A1 May 31, 2018

(30) Foreign Application Priority Data

Nov. 29, 2016 (JP) ..... 2016-231458
Sep. 29, 2017 (JP) ..... 2017-191650

(51) Int. Cl.

| | |
|---|---|
| ***G07D 5/00*** | (2006.01) |
| ***G07D 1/06*** | (2006.01) |
| ***G07D 3/14*** | (2006.01) |
| ***G07D 3/16*** | (2006.01) |

(52) U.S. Cl.
CPC ..... *G07D 1/06* (2013.01); *G07D 3/14* (2013.01); *G07D 3/16* (2013.01); *G07D 5/00* (2013.01)

(58) Field of Classification Search
CPC ..... G07D 5/00; G07F 3/00–3/04
See application file for complete search history.

(56) References Cited

U.S. PATENT DOCUMENTS 6,899,214 B2 * 5/2005 Morikawa ..... G07D 1/00 194/302

FOREIGN PATENT DOCUMENTS

JP 2000194904 A * 7/2000
JP 2011-039773 A 2/2011

OTHER PUBLICATIONS

Jinnai et al. (JP 2000-194904 A), Jul. 2000, JPO Computer Translation (Year: 2000).*

* cited by examiner

*Primary Examiner* — Erika J Villaluna
(74) *Attorney, Agent, or Firm* — Manabu Kanesaka

(57) ABSTRACT

A coin validation device that is implemented in a coin handling machine which stores therein a deposited coin on a denomination-by-denomination basis and which pays out stored coin in response to a disbursement instruction, the coin validation device, includes: a carrier that carries the deposited coin in a horizontally-fallen state in one direction; and a discriminator that identifies authenticity and denominations of the coin carried in the one direction by the carrier. Further, the carrier carries a coin, which is discriminated as a counterfeit coin by the discriminator, in another direction opposite to the one direction.

5 Claims, 40 Drawing Sheets

COIN VALIDATION DEVICE

CROSS-REFERENCE TO RELATED APPLICATION(S)

The present application claims priority to and incorporates by reference the entire contents of Japanese Patent Application No. 2016-231458 filed on Nov. 29, 2016 and Japanese Patent Application No. 2017-191650 filed on Sep. 29, 2017.

BACKGROUND

The present disclosure relates to a coin validation device.

In the related art, a coin handling machine that is implemented as, for example, a change machine identifies the authenticity and the denominations of the coins inserted from a coin depositing port, and then automatically introduces the coins identified authentic and stores them in coin storages provided according to the denominations. Moreover, in response to a change payout request received from an external device, the machine handling machine pays out coins, which are equal in amount to the requested sum of money from among the coins stored in the coin storages, as the change from a disbursement slot (for example, see Japanese Laid-open Patent Publication No. 2011-39773).

SUMMARY

There is a need for providing a coin validation device capable of implementing a downsized coin handling machine.

According to an embodiment of the present disclosure, a coin validation device that is implemented in coin handling machine which stores therein a deposited coin on a denomination-by-denomination basis and which pays out stored coin in response to a disbursement instruction, the coin validation device, includes: a carrier that carries the deposited coin in a horizontally-fallen state in one direction; and a discriminator that identifies authenticity and denominations of the coin carried in the one direction by the carrier. Further, the carrier carries a coin, which is discriminated as a counterfeit coin by the discriminator, in another direction opposite to the one direction.

DETAILED DESCRIPTION

In the coin handling machine in the related art, a plurality of belts is stretched in an endless manner around a pair of rollers, and the coins are carried by the belts arranged in such a way that the most upstream portion of a downstream-side belt is positioned on the lower side of the most downstream portion of the corresponding upstream-side belt. However, since each belt requires a certain level of carrying length, it is difficult to downsize the entire device as a result.

A preferred embodiment of a coin validation device accord in to the present disclosure is described below in detail with reference to the accompanying drawings.

Figure 1:
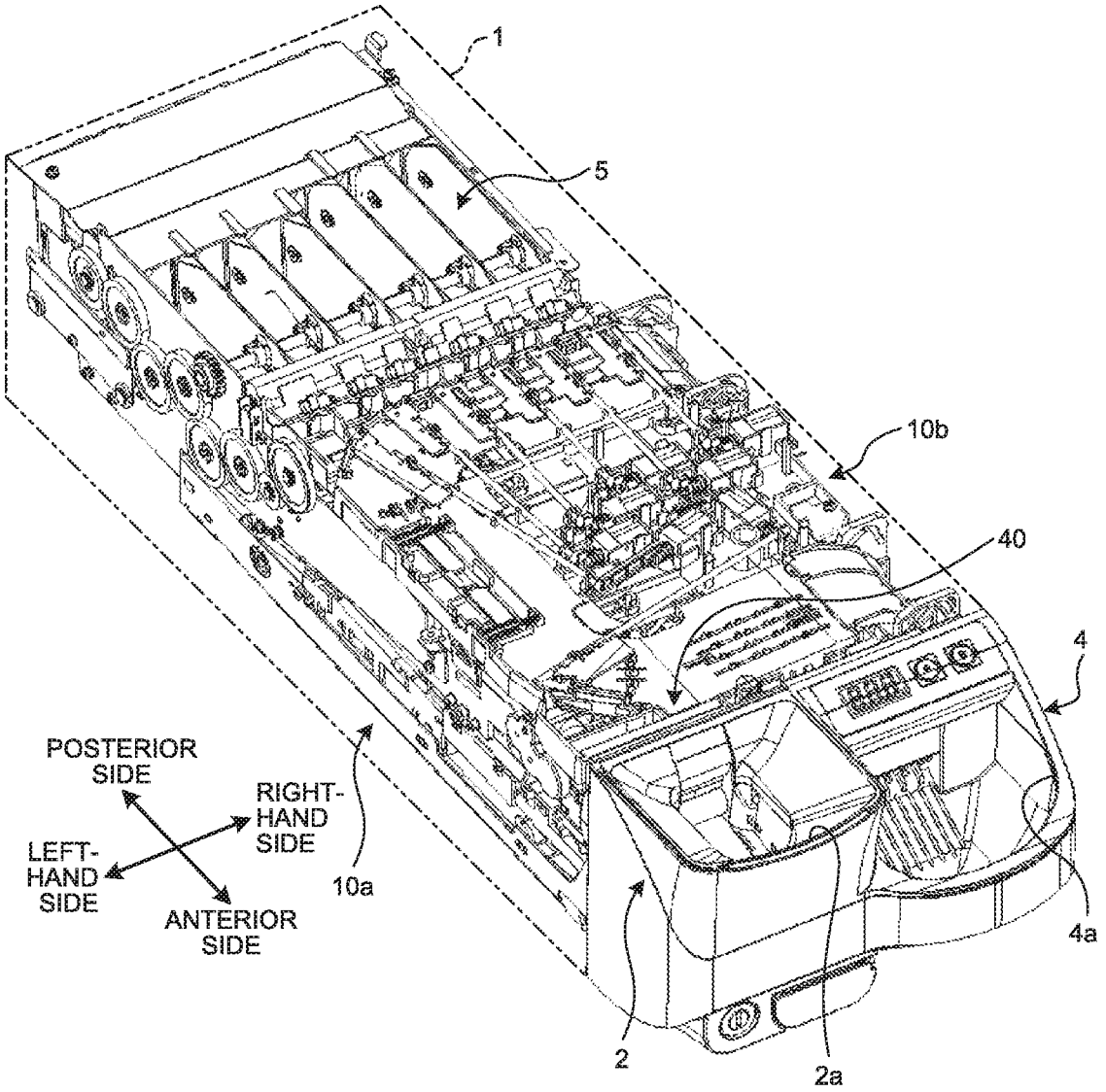
FIG. 1 is a perspective view illustrating the internal structure of a coin handling machine in which a coin validation device is implemented according to an embodiment of the present disclosure.

FIG. 1 is a perspective view illustrating the internal structure of a coin handling machine in which the coin validation device is implemented according to an embodiment of the present disclosure.

Figure 2:
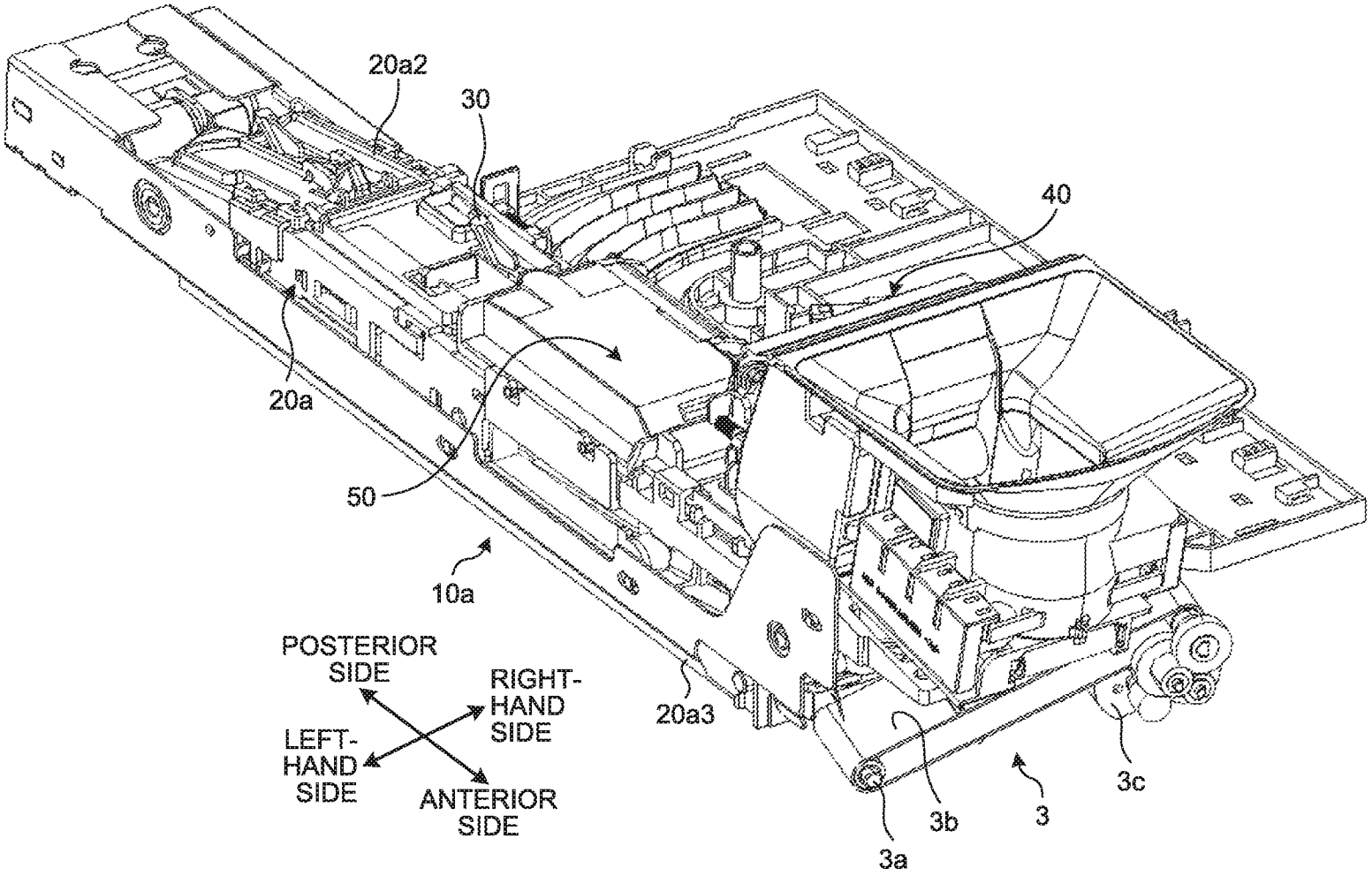
FIG. 2 is a perspective view illustrating, with appropriate omission of some constituent elements, the main components of the coin handling machine of FIG. 1.

A coin handling machine 1 illustrated in FIGS. 1 and 2 is implemented as, for example, a change machine that stores the deposited coins according to the denominations and pays out the stored coins in response to a disbursement instruction. The coin handling machine 1 includes a coin validation device 10*a* and a coin carrying device 10*b*.

Coin Validation Device

Figure 3:
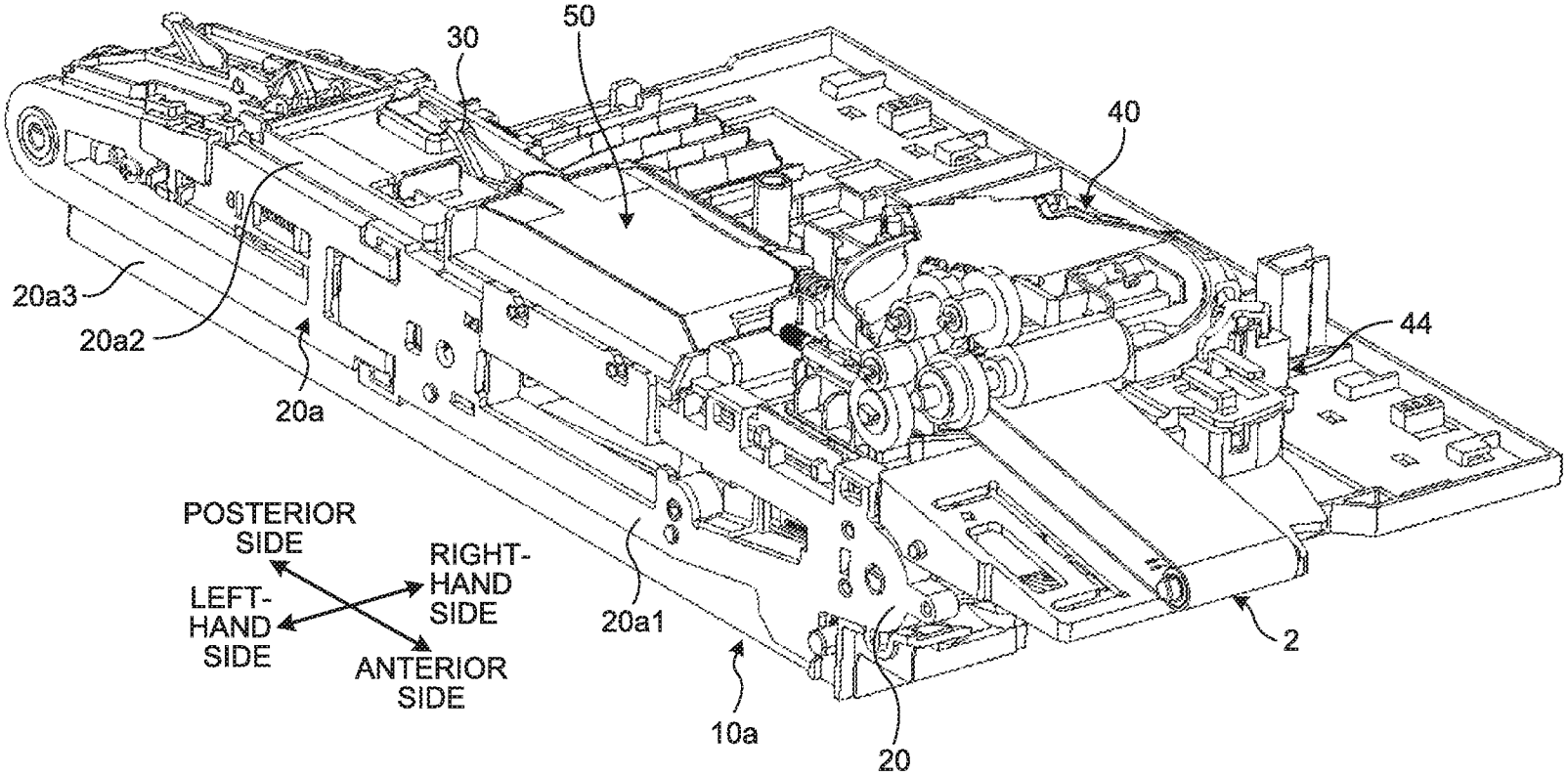
FIG. 3 is a perspective view illustrating, with appropriate omission of some constituent elements, main components of the coin handling machine illustrated in FIG. 1.
Figure 4:
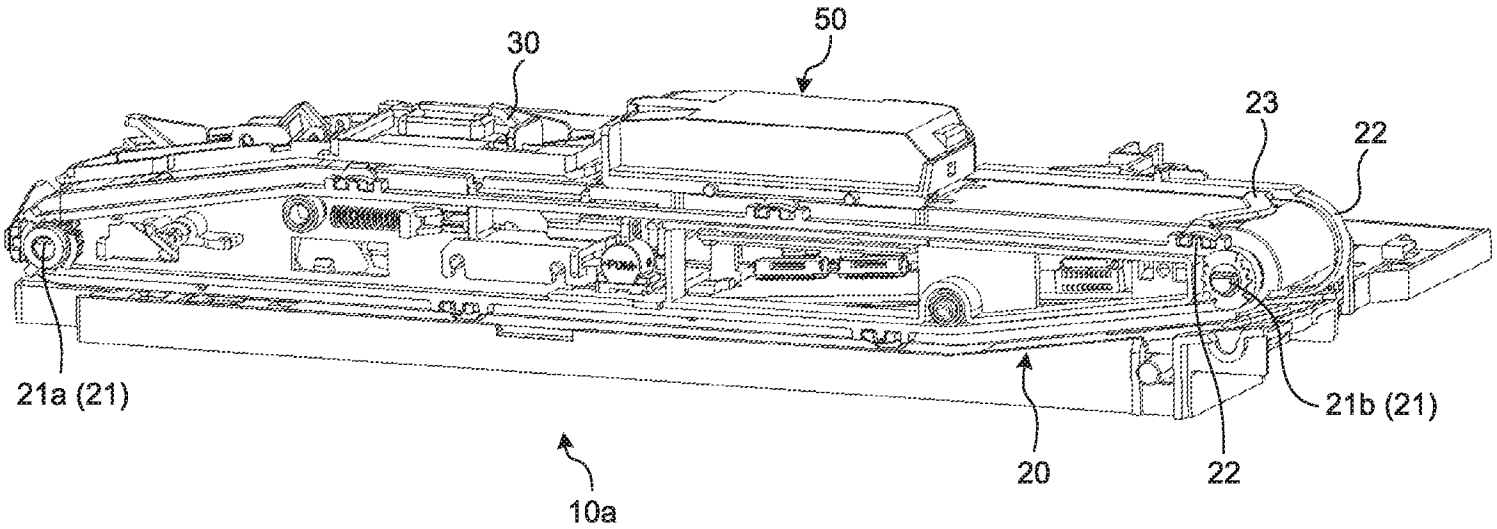
FIG. 4 is a perspective view illustrating, with appropriate omission of some constituent elements, main components of the coin handling machine of FIG. 1.
Figure 5:
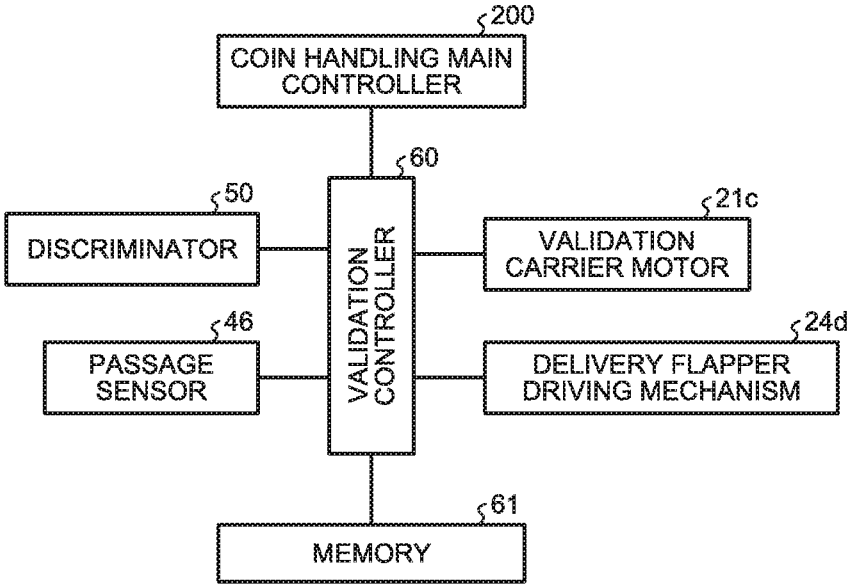
FIG. 5 is a block diagram that schematically illustrates a characteristic control system of the coin validation device illustrated in FIGS. 2 to 4.

FIGS. 2 to 4 are perspective views each illustrating, with appropriate omission of some constituent elements, the main components of the coin handling machine illustrated in FIG. 1. FIG. 5 is a block diagram that schematically illustrates the characteristic control system of the coin validation device 10*a* illustrated in FIGS. 2 to 4;

The coin validation device 10*a* illustrated in FIGS. 3 and 4 identifies the authenticity and the denominations of the coins deposited through a depositing port 2. As illustrated in FIG. 1, the depositing port 2 has a coin slot 2*a* from which the coins are deposited.

As illustrated in FIGS. 2 to 5, the coin validation device 10*a* includes a validated-coin carrying unit (a carrier) 20, a guiding member 30, a feeding flapper 31, a temporarily retaining mechanism 33, a validated-coin separating unit 40, a discriminating unit (a discriminator) 50, and a validation control unit 60.

Figure 6:
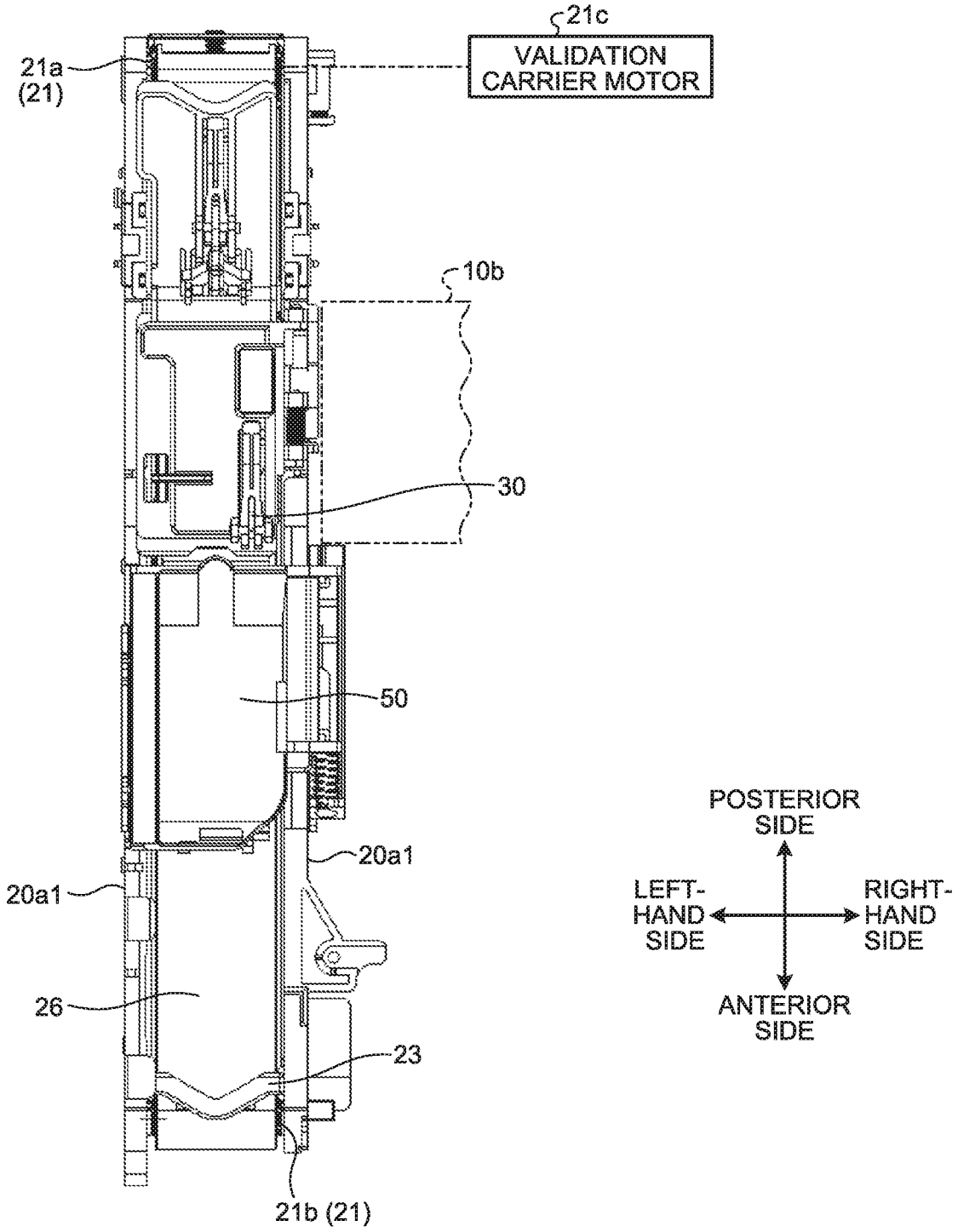
FIG. 6 is a planar view illustrating main components of the coin validation device illustrated in FIGS. 2 to 4.
Figure 7:
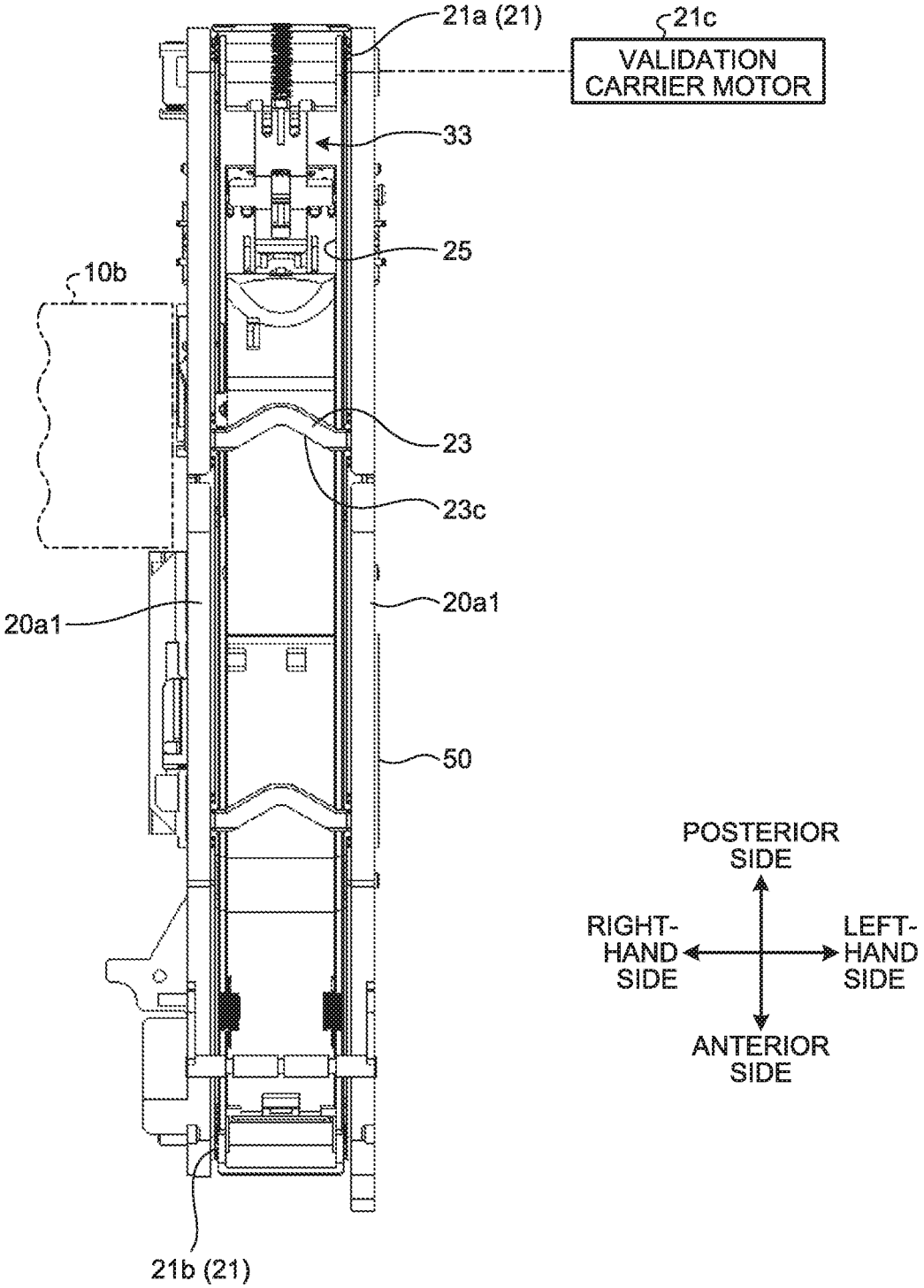
FIG. 7 is a bottom view illustrating the main components of the coin validation device illustrated in FIGS. 2 to 4.
Figure 8:
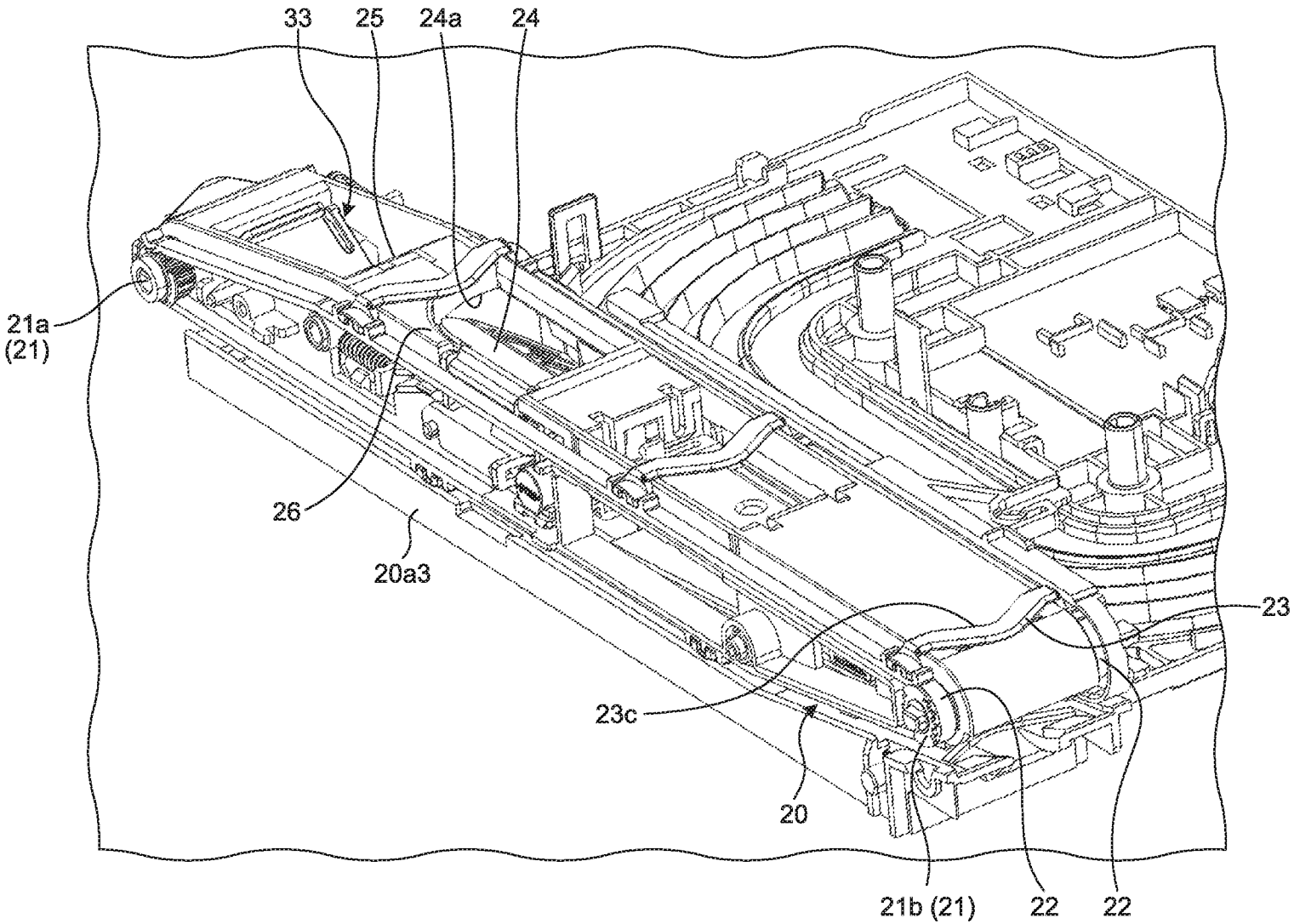
FIG. 8 is a perspective view illustrating the main components of the coin validation device illustrated in FIGS. 2 to 4.

FIGS. 6 to 8 illustrate the main components of the coin validation device 10*a* illustrated in FIGS. 2 to 4, respectively. FIG. 6 is a planar view, FIG. 7 is a bottom view, and FIG. 8 is a perspective view. As illustrated in FIGS. 6 and 8, the validated-coin carrying unit 20 includes carrier pulleys 21, carrier belts 22, pressure-carrying members (carrying members) 23, a delivery flapper 24, and a counterfeit-coin through hole 25.

The carrier pulleys 21 are installed as a pair of antero-posterior pulleys inside a carrying device main body 20*a* (see FIG. 2 and FIG. 3) representing the housing. A posterior carrier pulley 21*a* is linked to the output shaft of a validation carrier motor 21*c* via a linkage gear unit (not illustrated). The validation carrier motor 21*c* is driven in the forward or reverse direction in response to a driving instruction issued by the validation control unit 60, and the driving of the validation carrier motor 21*c* is terminated in response to a driving termination instruction issued by the validation control unit 60. More specifically, the validation carrier motor 21*c* is driven in the forward direction when a forward direction driving instruction is issued by the validation control unit 60, and the validation carrier motor 21*c* is driven in the reverse direction when a reverse driving instruction is issued by the validation control unit 60.

The posterior carrier pulley 21*a* is a drive pulley that, as a result of the driving (forward driving or reverse driving) of the validation carrier motor 21*c*, rotates around the shaft center thereof represented by the central shaft thereof. Driven in the forward driving direction by the validation carrier motor 21*c*, the posterior carrier pulley 21*a* rotates in the counterclockwise direction when viewed from the left-hand side. Driven in the reverse driving direction by the validation carrier motor 21*c*, the posterior carrier pulley 21*a* rotates in the clockwise direction when viewed from the left-hand side.

The carrier belts 22 represent a pair of right-left belts that are stretched in an endless manner around the carrier pulleys 21. When the posterior carrier pulley 21*a* rotates because of the driving of the validation carrier motor 21*c*, the carrier belts 22 get displaced along the direction of extension thereof. More specifically, if the posterior carrier pulley 21*a* rotates in the counterclockwise direction when viewed from the left-hand side by the validation carrier motor 21*c* driving in the forward driving direction, the carrier belts 22 get displaced in such a way that the upper portion thereof moves toward the posterior side and the lower portion thereof moves toward the anterior side. By contrast, if the posterior carrier pulley 21*a* rotates in the clockwise direction when viewed from the left-hand side by the validation carrier motor 21*c* driving in the reverse driving direction, the carrier belts 22 get displaced in such a way that the upper portion thereof moves toward the anterior side and the lower portion thereof moves toward the posterior side.

An anterior carrier pulley 21*b* is linked to the posterior carrier pulley 21*a* via the carrier belts 22, and, if the posterior carrier pulley 21*a* rotates in the counterclockwise direction when viewed from the left-hand side, the anterior carrier pulley 21*b* rotates in the counterclockwise direction when viewed from the left-hand side, around the central shaft thereof. If the posterior carrier pulley 21*a* rotates in the clockwise direction when viewed from the left-hand side, the anterior carrier pulley 21*b* rotates in the clockwise direction when viewed from the left-hand side, around the central shaft thereof. That is, the anterior carrier pulley 21*b* is a driven pulley that rotates according to the rotation of the posterior carrier pulley 21*a*.

Figure 9:
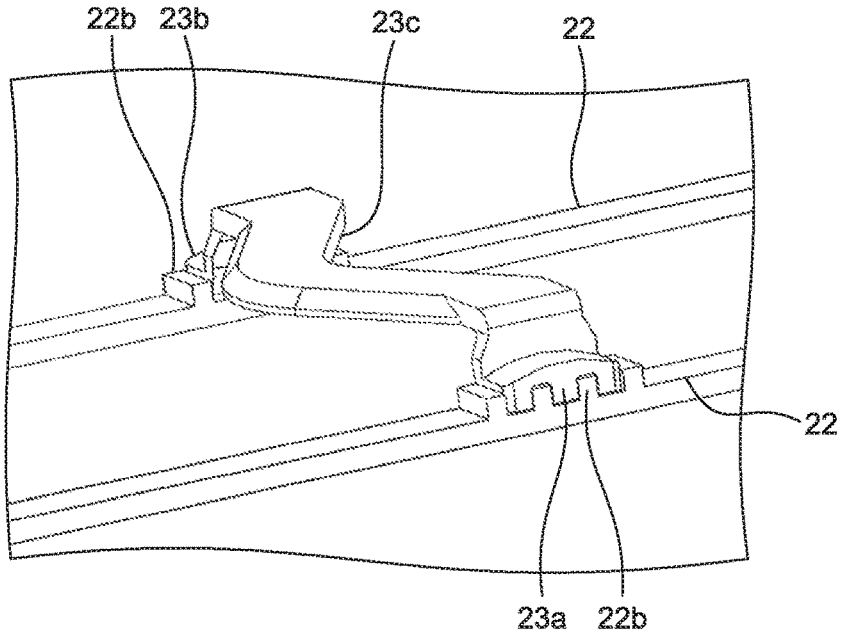
FIG. 9 is an enlarged perspective view illustrating portions of attachment between carrier belts and a pressure-carrying member.

A plurality of pressure-carrying members 23 is installed at regular intervals along the direction of extension of the carrier belts 22, and each pressure-carrying member 23 is installed across the pair of right-left carrier belts 22. As illustrated in FIG. 9, in each pressure-carrying member 23, a right-end uneven portion 23*a* formed on the right end engages with a right-side uneven portion 22*a* formed on the carrier belt 22 on the right-hand side; and a left-end uneven portion 23*b* formed on the left end engages with a left-side uneven portion 22*b* formed on the carrier belt 22 on the left-hand side. As a result, the pressure-carrying member 23 is fixed across the pair of right-left carrier belts 22. With that, according to the displacement of the carrier belts 22, the pressure-carrying members 23 get displaced along the direction of extension of the carrier belts 22. Meanwhile, although the right-end uneven portion 23*a* and the left-end uneven portion 23*b* of each pressure-carrying member 23 engage with the right-side uneven portion 22*a* and the left-side uneven portion 22*b*, respectively, of the carrier belts 22 for fixation; the movement of the pressure-carrying members 23 in the right-left direction with respect to the carrier belts 22 is regulated by a right-left both-side portion 20*a*1 of the carrying device main body 20*a*, the movement of the pressure-carrying members 23 in the upward direction with respect to the carrier belts 22 is regulated by a ceiling portion 20*a*2 of the carrying device main body 20*a*, and the movement of the pressure-carrying members 23 in the downward direction with respect to the carrier belts 22 is regulated by a base portion 20*a*3 of the carrying device main body 20*a*.

Figure 10:
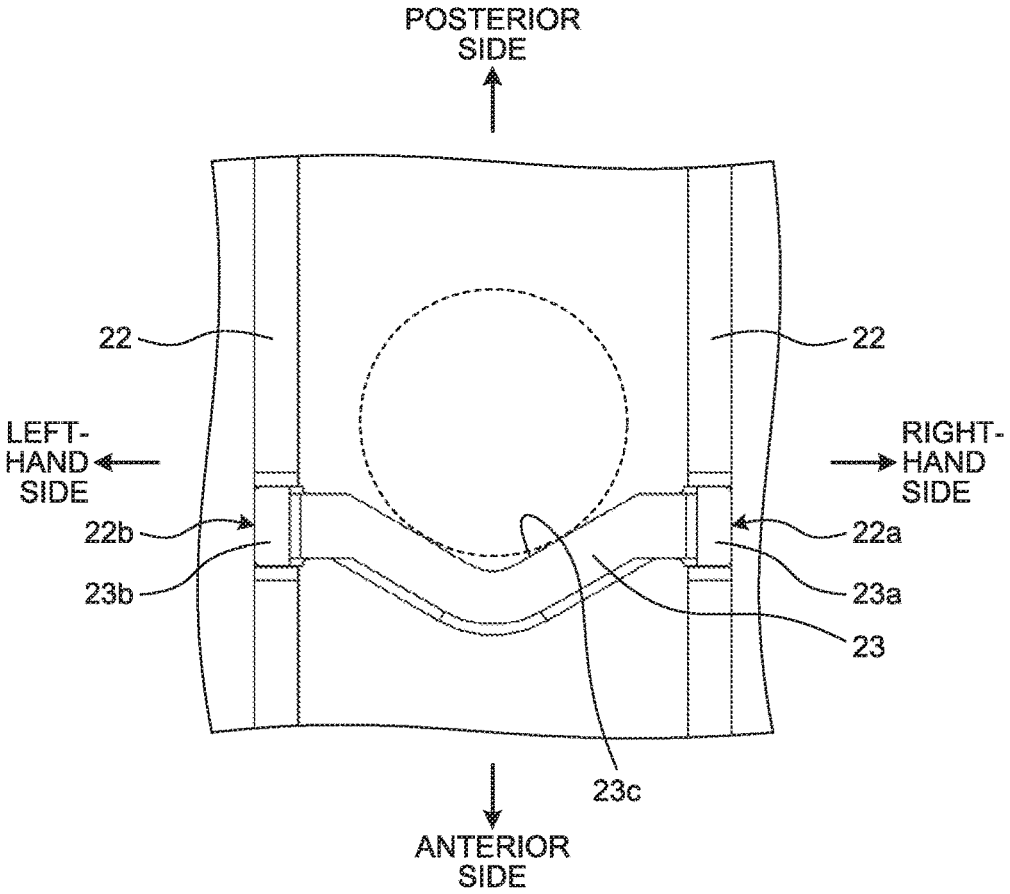
FIG. 10 is an enlarged planar view illustrating the pressure-carrying member that is displaced toward the posterior side by the carrier belts.

In each pressure-carrying member 23, a face 23*c* approaching the downstream side of the direction of displacement of the carrier belts 22 if the posterior carrier pulley 21*a* rotates in the counterclockwise direction when viewed from the left-hand direction, that is, the face approaching the posterior side in the upper portion of the carrier belts 22 and approaching the anterior side in the lower portion of the carrier belts 22 is a V-shaped face. That is, as illustrated in FIG. 10 too, in each pressure-carrying member 23, at the face 23*c* approaching the downstream side in the direction of displacement of the carrier belts 22, a face that goes on tilting toward the downstream side of the direction of displacement while heading in the left-hand side direction and a face that goes on tilting toward the upstream side of the direction of displacement while heading in the right-hand side direction become continuous at the middle portion and form a V-shaped face.

As illustrated in FIG. 8, the delivery flapper 24 is placed in a carrier base portion 26 provided in between the pair of right-left carrier belts 22. More specifically, the delivery flapper 24 is swingably placed at the left-side edge of a delivery opening 24*a* that is formed on the carrier base portion 26. The delivery opening 24*a* is an opening communicated with a delivery passage 24*b* (see FIG. 12) and enables delivery of a coin passing therethrough to the coin carrying device 10*b* via the delivery passage 24*b*.

In the normal state, the delivery flapper 24 closes the delivery opening 24*a* so as to regulate the passage of coins. When a delivery flapper driving mechanism 24*d* is driven, the delivery flapper 24 swings in the opening direction and opens the delivery opening 24*a*. Upon receiving a driving instruction from the validation control unit 60, the delivery flapper driving mechanism 24*d* is driven and makes the delivery flapper 24 swing in the opening direction. Upon receiving a driving termination instruction from the validation control unit 60, the driving of the delivery flapper driving mechanism 24*b* is terminated, thereby allowing the delivery flapper 24 to close the delivery opening 24*a*.

As illustrated in FIG. 8, the counterfeit-coin through hole 25 is a rectangular hole formed on the posterior side of the delivery opening 24*a* of the carrier base portion 26. The counterfeit-coin through hole 25 is sufficiently large to allow the passage of coins. The coins that pass through the counterfeit-coin through hole 25 are stocked in the base portion 20*a*3 of the carrying device main body 20*a*.

Figure 11:
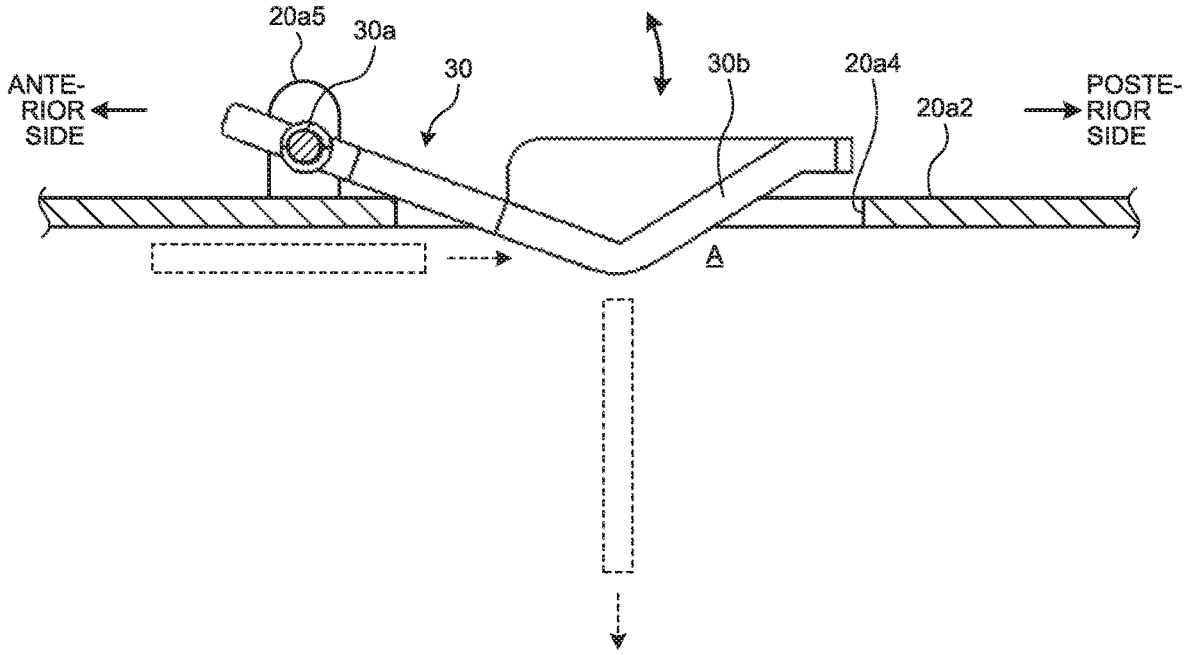
FIG. 11 is an enlarged explanatory diagram illustrating a guiding member illustrated in FIGS. 3 and 4 and the surrounding structure of the guiding member.

As illustrated in FIGS. 2 to 4, the guiding member 30 is placed in the upper portion of the delivery opening 24*a* and on the ceiling portion 20*a*2 of the carrying device main body 20*a*. As illustrated in FIG. 11, the guiding member 30 includes a guiding shaft 30*a* and a guiding action portion 30*b*.

The guiding shaft 30*a* is a columnar member extending along the right-left direction. The guiding action portion 30*b* extends in the radially outward direction of the guiding shaft 30*a*. More specifically, the guiding action portion 30*b* extends toward the posterior direction.

Regarding the guiding member 30, the guiding shaft 30*a* is erected on a guiding support piece 20*a*5, which is provided in the ceiling portion 20*a*2, in such a way that the guiding action portion 30*b* passes through a guiding opening 20*a*4 formed on the ceiling portion 20*a*2. As a result, the guiding member 30 becomes swingable around the central shaft of the guiding shaft 30*a*.

More specifically, the guiding member 30 is swingably provided in such a way that the lower-end portion of the guiding action portion 30*b* moves in and out of a passage area A across which the coins are carried toward the posterior side by the validated-coin carrying unit 20. In the normal state, the lower-end portion of the guiding action portion 30*b* moves in the passage area A. When the delivery opening 24*a* is closed by the delivery flapper 24, the guiding member 30 swings to move out from the passage area A by being pressed by the coins passing through the passage area A, and thus allows the coins to move toward the posterior side. When the delivery opening 24*a* is opened by the delivery flapper 24, the guiding member 30 abuts against the coins passing through the passage area A, and guides the coins to the delivery opening 24*a*.

Figure 12:
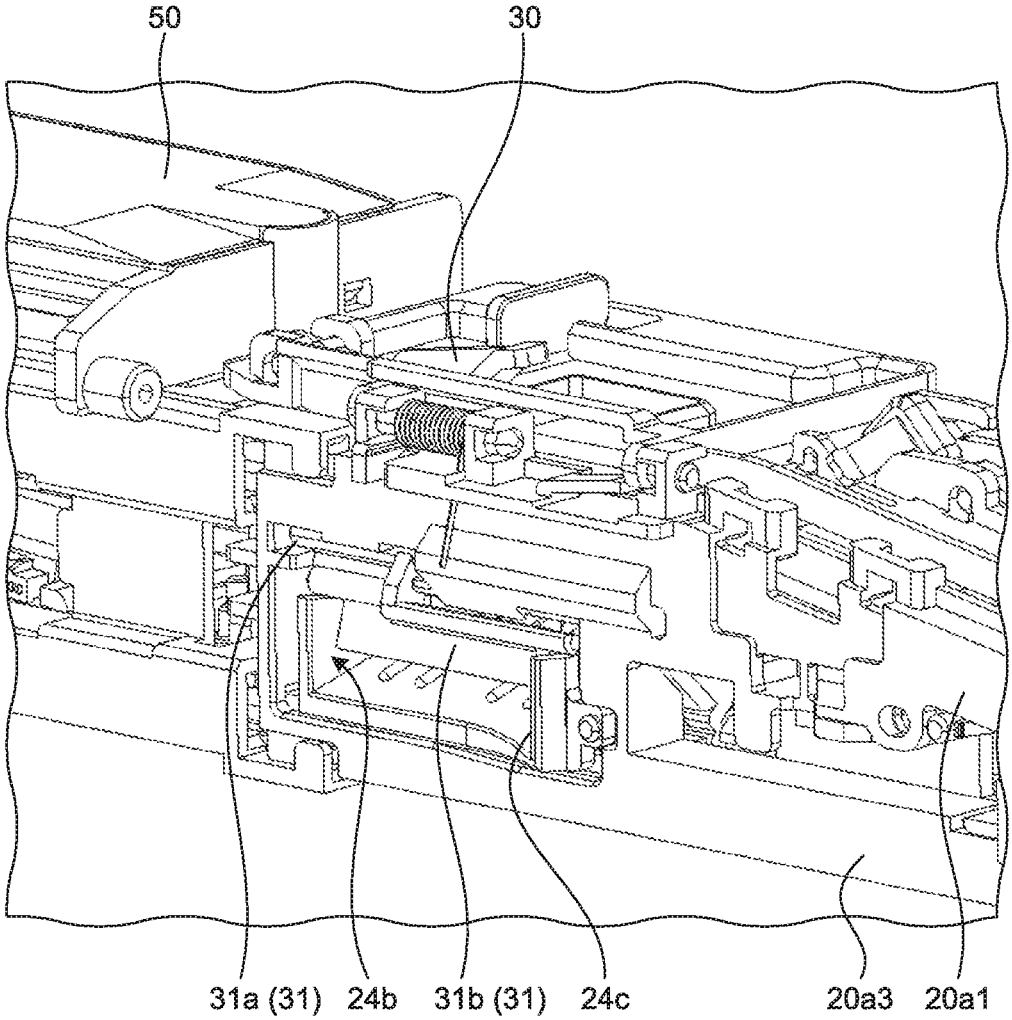
FIG. 12 is a perspective view illustrating the main components of the coin validation device illustrated in FIGS. 2 to 4.

As illustrated in FIG. 12, the feeding flapper 31 is disposed to block a part of a delivery opening 24*c* functioning as an outlet port of the delivery passage 24*b*. The feeding flapper 31 includes a flapper shaft 31*a* and a flapper action portion 31*b*. The flapper shaft 31*a* is a columnar member extending along the front-back direction. The flapper action portion 31*b* extends in the radially outward direction of the flapper shaft 31*a*. More specifically, the flapper action portion 31*b* extends downward.

Regarding the feeding flapper 31, the flapper shaft 31*a* is pivotally supported to block a part of the delivery opening 24*c* with the flapper action portion 31*b*. As a result, the feeding flapper 31 becomes swingable around the central shaft of the flapper shaft 31*a*.

In the normal state, the feeding flapper 31 is restricted to swing toward the left-hand side when the flapper action portion 31*b* blocks a part of the delivery opening 24*c*. Accordingly, the feeding flapper 31 prevents a coin from the coin carrying device 10*b* from passing the delivery opening 24*c* to enter the delivery passage 24*b*. When the feeding flapper 31 abuts against the coin passed through the delivery passage 24*b*, the feeding flapper 31 swings toward the right-hand side around the central shaft of the flapper shaft 31*a*, thereby opening the delivery opening 24*c* to allow coins to pas therethrough.

Figure 13:
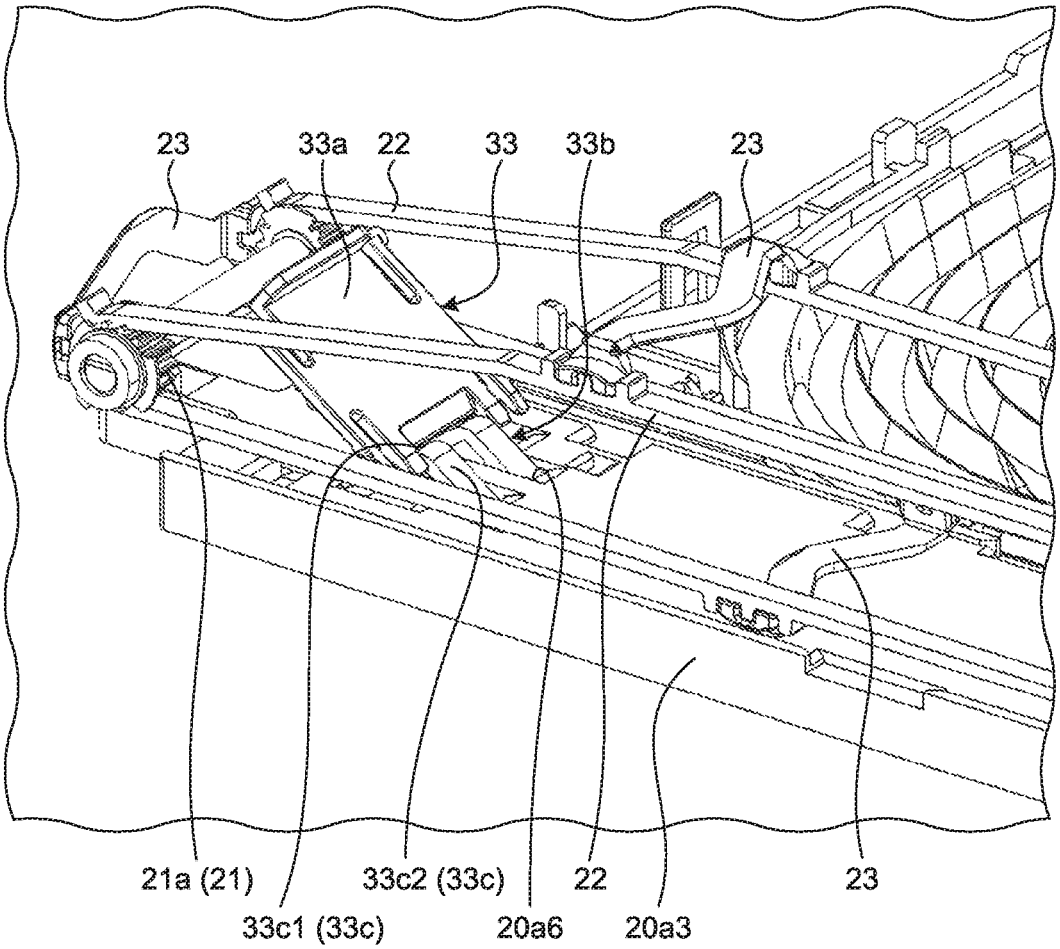
FIG. 13 is a perspective view illustrating the main components of the coin validation device illustrated in FIGS. 2 to 4.
Figure 14:
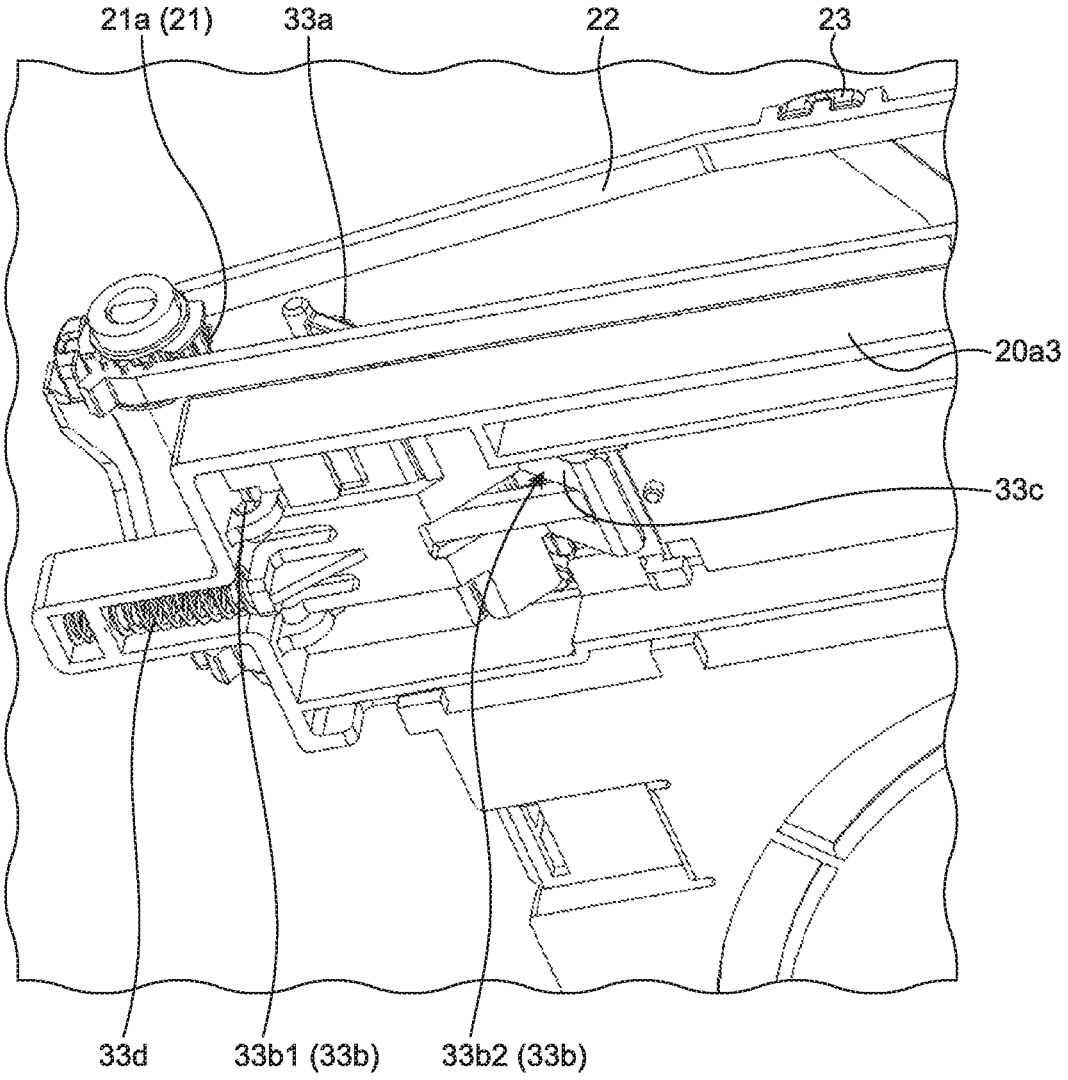
FIG. 14 is a perspective view illustrating the main components of the coin validation device illustrated in FIGS. 2 to 4.

As illustrated in FIG. 3, the temporarily retaining mechanism 33 is formed and inserted in the counterfeit-coin through hole 25. As illustrated in FIG. 13 and FIG. 14, the temporarily retaining mechanism 33 includes a temporarily retaining portion 33*a* and a temporarily retaining lever 33*b*. The temporarily retaining portion 33*a* is a plate member that gradually inclines upward toward the posterior side and is inserted in the counterfeit-coin through hole 25. The lower-end portion of the temporarily retaining portion 33*a* and the base portion 20*a*3 form therebetween a gap through which the pressure-carrying members 23 are allowed to pass.

The temporarily retaining lever 33*b* includes a retaining lever shaft 33*b*1 and a retaining lever action portion 33*b*2. The retaining lever shaft 33*b*1 is a shaft-like member extending along the right-left direction and is pivotally supported on a lower portion of the base portion 20*a*3. As a result, the temporarily retaining lever 33*b* becomes swingable around the central shaft of the retaining lever shaft 33*b*1.

The retaining lever action portion 33*b*2 extends in the radially outward direction of the retaining lever shaft 33*b*1. More specifically, the retaining lever action portion 33*b*2 extends toward the anterior side. The retaining lever action portion 33*b*2 has a front-end portion 33*c* having, in a continuous manner, a first inclined surface 33*c*1 that gradually inclines upward toward the anterior side and a second inclined surface 33*c*2 that gradually inclines upward toward the posterior side. The second inclined surface 33*c*2 is disposed closer to the anterior side than the first inclined surface 33*c*1 is.

A lever spring 33*d* is interposed between the temporarily retaining lever 33*b* and the base portion 20*a*3. By the lever spring 33*d*, the front-end portion 33*c* of the temporarily retaining lever 33*b* is moved into the upper area of the base portion 20*a*3 through a lever opening 20*a*6 provided to the base portion 20*a*3.

Figure 15:
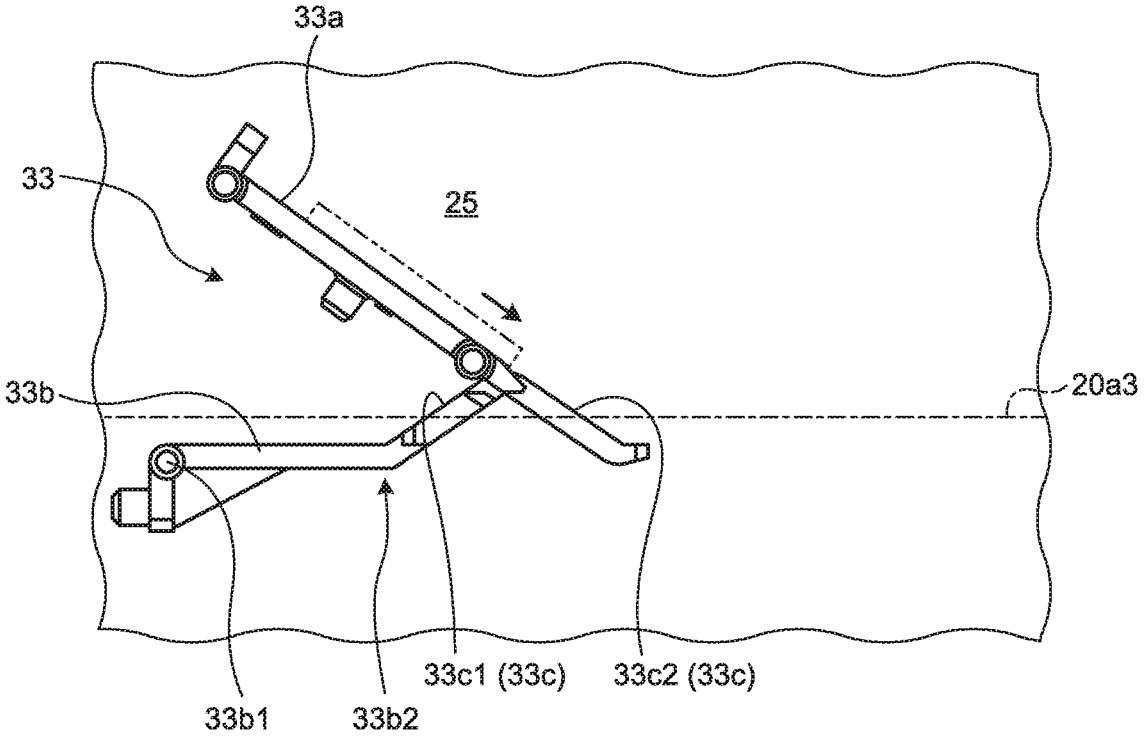
FIG. 15 is an explanatory diagram illustrating an action of a temporarily retaining mechanism illustrated in FIGS. 13 and 14.

As illustrated in FIG. 15, in the normal state, the second inclined surface 33*c*2 on the front-end portion 33*c* forms substantially the same slope as that of the temporarily retaining portion 33*a*, and thus the temporarily retaining lever 33*b* can guide a coin (counterfeit-coin) passing through the counterfeit-coin through hole 25 downward.

The validated-coin separating unit 40 separates one coin at a time from among the coins deposited through the depositing port 2, and sends each separated coin to the validated-coin carrying unit 20.

Figure 16:
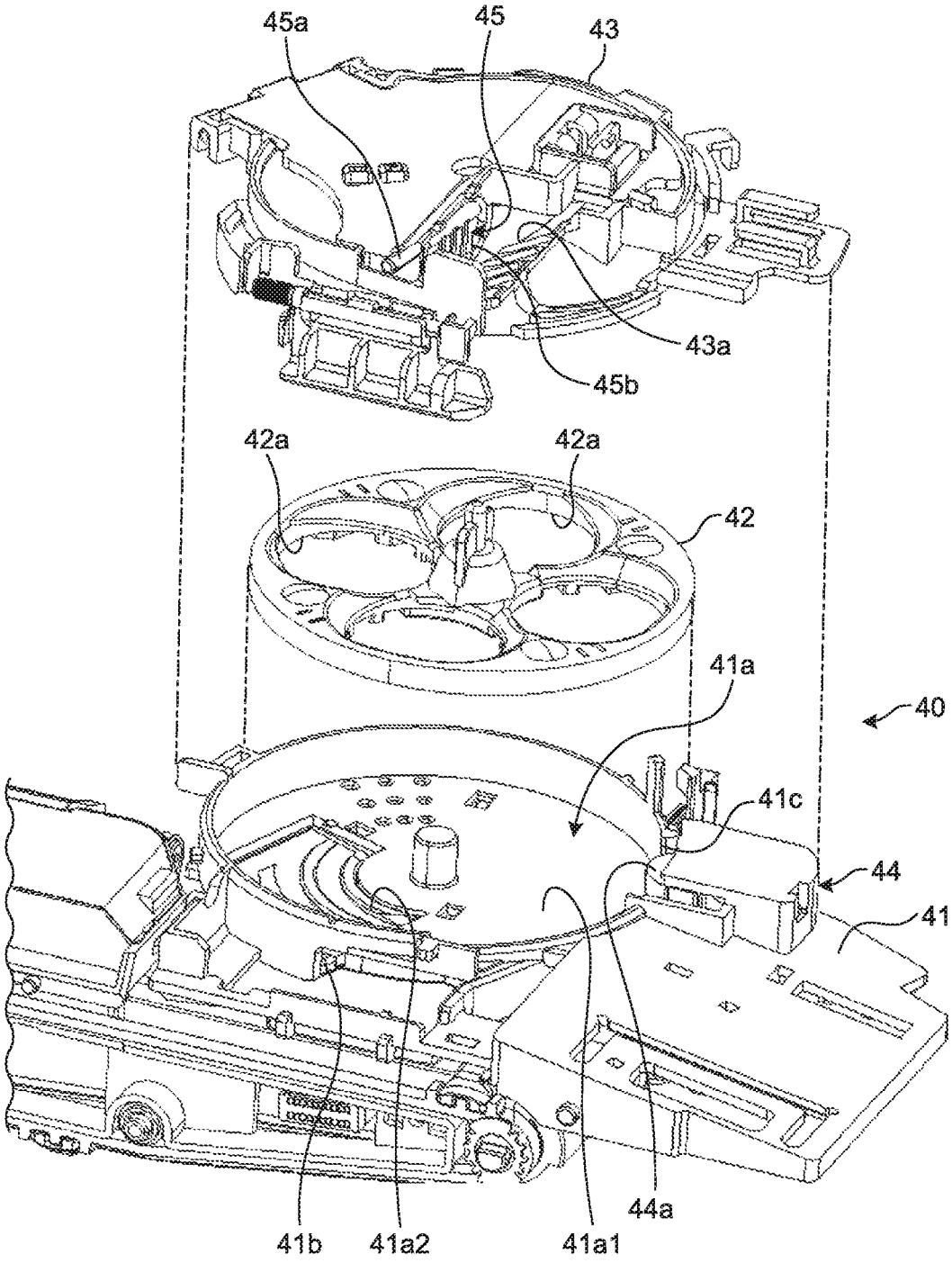
FIG. 16 is an exploded perspective view illustrating the main components of a validated-coin separating unit of FIG. 3.

FIG. 16 is an exploded perspective view illustrating the main components of a validated-coin separating unit 40 illustrated in FIG. 3. As illustrated in FIG. 16, the validated-coin separating unit 40 includes a separation main body 41, a rotating body 42, and a separating lid 43.

The separation main body 41 includes a rotating-body container 41*a* that has the shape of a bottomed cylinder, and has a driving force application opening 41*c* formed therein for the purpose of applying a rotary driving force to a supply port 41*b*, which supplies coins to the validated-coin carrying unit 20, and the rotating body 42. On a bottom face 41*a*1 of the rotating-body container 41*a* in the separation main body 41, a separating-guiding portion 41*a*2 is disposed for the purpose of guiding the coins to the supply port 41*b*.

The rotating body 42 is substantially disk-shaped, and is housed in the rotating-body container 41*a* of the separation main body 41 in a rotatable manner around the central shaft of itself. In the rotating body 42, a plurality of (in the example illustrated in FIG. 12, four) coin passage holes 42*a* that are concyclic in nature are formed around the central shaft.

On the lateral face of the rotating body 42, a gear 44*a* of a driving force transmitting unit 44 gets interlocked via the driving force application opening 41*c*. The driving force transmitting unit 44 is present in between the anterior carrier pulley 21*b* and the rotating body 42, and transmits the rotary driving force of the carrier pulleys 21 to the rotating body 42.

As described above, the anterior carrier pulley 21*b* is a driven pulley that rotates according to the rotation of the posterior carrier pulley 21*a*. Thus, the rotary driving force of the rotating body 42 is provided by the validation carrier motor 21*c*. That is, the rotation of the rotating body 42 and the rotation of the carrier pulleys 21 are provided from a common driving source, and synchronization is achieved between the rotation of the rotating body 42 and the displacement of the carrier belts 22.

The separating lid 43 is installed for covering the rotating-body container 41*a* of the separation main body 41. In the separating lid 43, an inlet 43*a* and a movable flapper 45 are provided. The inlet 43*a* is an opening for letting the coin, which has been deposited from the depositing port 2, into the rotating body 42 in the rotating-body container 41*a*.

The movable flapper 45 includes a movable shaft 45*a* and a movable action portion 45*b*. The movable shaft 45*a* is a columnar member extending along the right-left direction. The movable action portion 45*b* extends in the radially outward direction of the movable shaft 45*a*. More specifically, the movable action portion 45*b* extends downward.

Regarding the movable flapper 45, the movable shaft 45*a* is pivotally supported on the separating lid 43, in such a way that the movable action portion 45*b* passes through the inlet 43*a*. As a result, the movable flapper 45 becomes swingable around the central shaft of the movable shaft 45*a*. More specifically, the movable flapper 45 is installed in a swingable manner, with some part of the leading end of the movable action portion 45*b* making contact with the top face of the rotating body 42.

In the validated-coin separating unit 40, a passage sensor 46 (see FIG. 5) is disposed. The passage sensor 46 is disposed on a carrying pathway along which a coin deposited from the inlet 43*a* is carried to the supply port 41*b* by rotation of the rotating body 42, and detects a coin passing thereby. When detecting the passage of a coin, the passage sensor 46 issues a passage signal as the detected passage to the validation control unit 60 described later.

Figure 17:
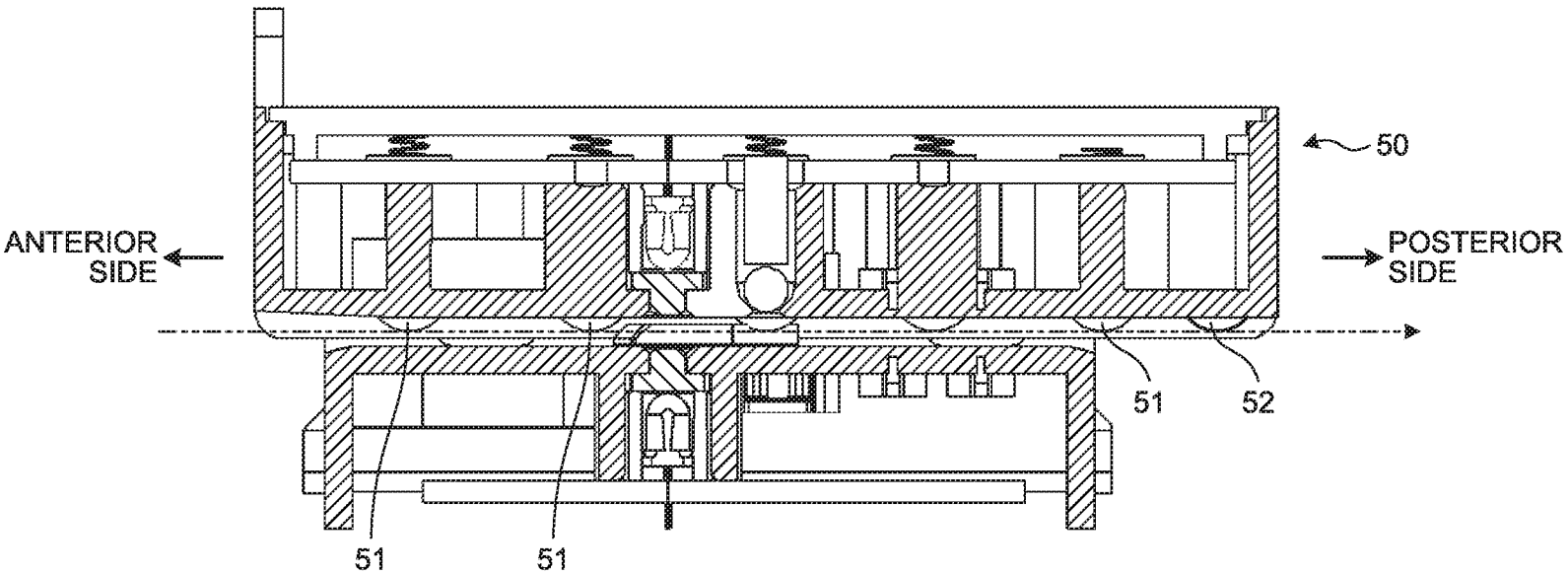
FIG. 17 is a vertical cross-sectional view of a discriminating unit illustrated in FIGS. 2 to 4.
Figure 18:
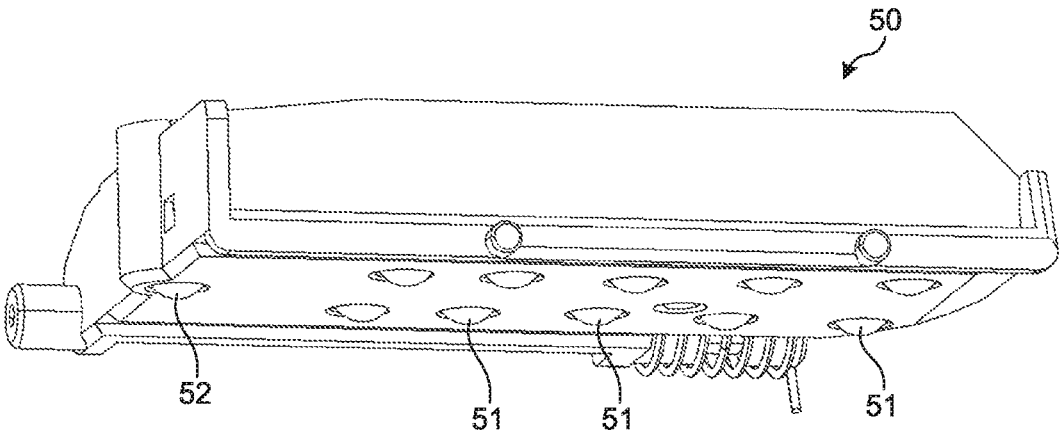
FIG. 18 is a perspective view of main components of a discriminating unit illustrated in FIGS. 2 to 4.
Figure 19:
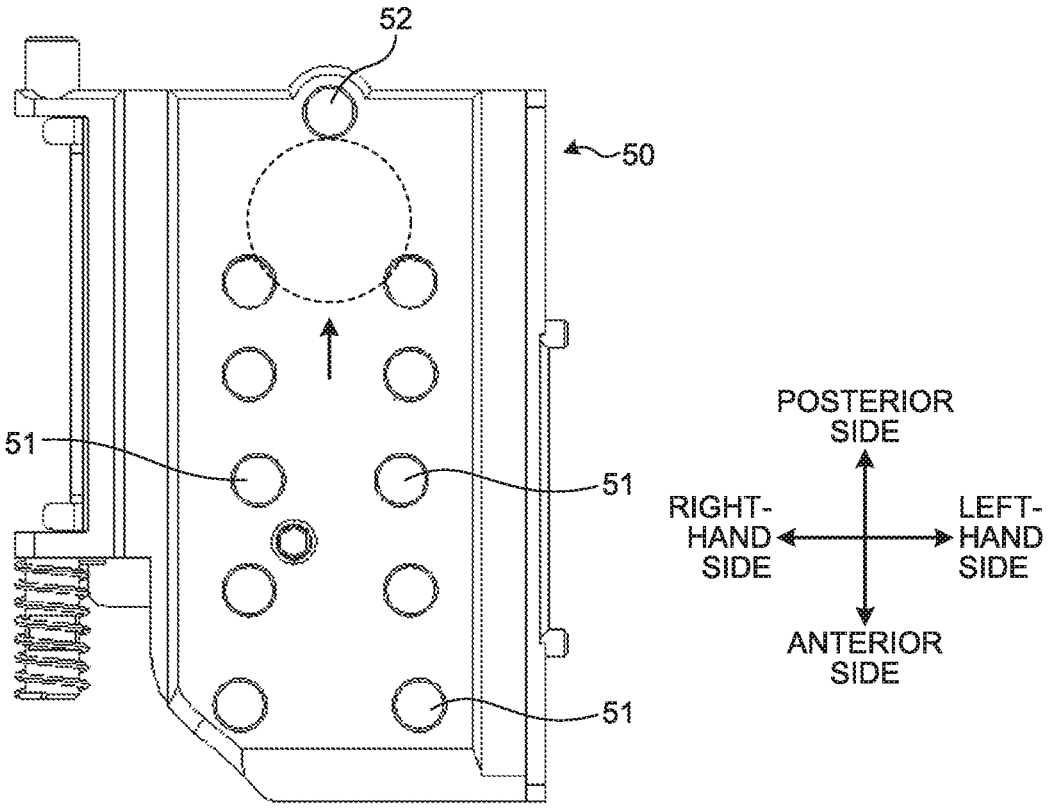
FIG. 19 is a perspective view of main components of a discriminating unit illustrated in FIGS. 2 to 4.

As illustrated in FIGS. 2 to 4, the discriminating unit 50 is disposed on a position that is closer to the posterior side than the validated-coin separating unit 40 is and closer to the anterior side than the delivery opening 24*a* is. When a coin that has been carried toward the posterior side by the validated-coin carrying unit 20 passes across a predetermined discrimination area, the discriminating unit 50 identifies the authenticity and the denomination of that coin. Then, the discriminating unit 50 sends the discrimination result as a discrimination signal to the validation control unit 60. Moreover, as illustrated in FIGS. 17 to 19, the discriminating unit 50 includes a plurality of ball pressure members 51 for pressing, from above, the coin that is passing toward the posterior side.

The discriminating unit 50 includes a slow-down ball pressure 52 at the farthest posterior side thereof. The slow-down ball pressure 52 prevents the coin that has passed across the discrimination area from braking away from the pressure-carrying members 23.

The validation control unit 60 comprehensively controls the operations of the coin validation device 10*a* according to computer programs and data stored in a memory 61. For example, the validation control unit 60 can be implemented by making a processor such as a central processing unit (CPU) to execute computer programs, that is, can be implemented using software; or can be implemented using hardware such as an integrated circuit; or can be implemented using a combination of software and hardware.

In the coin validation device 10*a* having the abovementioned configuration, when a plurality of coins are deposited through the depositing port 2, an operation instruction is issued to the validation control unit 60 from a coin handling main controller 200 that comprehensively controls the operations of the coin handling machine 1, and then the validation control unit 60 issues a forward direction driving instruction to the validation carrier motor 21*c*.

That results in the forward driving of the validation carrier motor 21*c* and, in the validated-coin carrying unit 20, the carrier pulleys 21 rotate in the counterclockwise direction, when viewed from the left-hand side, so that the carrier belts 22 get displaced along the direction of extension. Moreover, as a result of rotation of the carrier pulleys 21, the rotating body 42 of the validated-coin separating unit 40 rotates, via the driving force transmitting unit 44, in the clockwise direction when viewed from above.

When the coins that are deposited through the depositing port 2 reach the top face of the rotating body 42 through the inlet 43*a* of the separating lid 43, the validated-coin separating unit 40 guides each coin in the horizontally-fallen state to the corresponding coin passage hole 42*a*. As a result, the coins guided to each coin passage hole 42*a* get stacked therein.

From among the coins stacked in each coin passage hole 42*a*, the lowermost coin makes a sliding contact with the bottom face 41*a*1 of the rotating-body container 41*a* in the separation main body 41 due to the rotation of the rotating body 42. The lowermost coin, which has abutted against the separating-guiding portion 41*a*2, is separated from the corresponding coin passage hole 42*a* and supplied to the validated-coin carrying unit 20 through the supply port 41*b*. That is, the validated-coin separating unit 40 separates one coin at a time from among the coins deposited through the depositing port 2, and sends the separated coin to the validated-coin carrying unit 20.

The coin that is supplied to the validated-coin carrying unit 20 through the supply port 41*b* gets placed in the horizontally-fallen state on the top face of the carrier base portion 26. As described above, since the carrier belts 22 get displaced in their direction of extension, the pressure-carrying members 23 fixed to the carrier belts 22 press the coin, which is placed on the top face the carrier base portion 26, toward the posterior side and carry the coin toward the posterior side.

In each pressure-carrying member 23, the face 23*c* approaching the downstream side of the direction of displacement of the carrier belts 22 is a V-shaped face. Hence, as illustrated in FIG. 10, the face 23*c* approaching the downstream side serves as the face that presses the coin due to the displacement of the carrier belts 22; and thus the coin can be carried toward the posterior side while keeping it close to the middle portion in the right-left direction.

When the coin that is carried toward the posterior side while being pressed by the pressure-carrying member 23 reaches the discrimination area of the discriminating unit 50, the authenticity and the denomination of that coin is identified by the discriminating unit 50. Then, the discriminating unit 50 sends the discrimination result as a discrimination signal to the validation control unit 60.

The validation control unit 60 receives input of the discrimination signal from the discriminating unit 50 and, if the discrimination result indicates that the coin is authentic, issues a driving instruction to the delivery flapper driving mechanism 24*d*. That results in the driving of the delivery flapper driving mechanism 24*d*, and the delivery flapper 24 swings in the opening direction and opens the delivery opening 24*a*. Once the delivery flapper 24 opens the delivery opening 24*a*, the coin that has passed across the discrimination area and that has been carried toward the posterior side while being pressed by the pressure-carrying member 23 abuts against the guiding member 30, passes through the delivery opening 24*a* and delivery passage 24*b* while changing the orientation thereof, and gets delivered to the coin carrying device 10*b* from the delivery opening 24*c*. After the coin that is discriminated as authentic passes through the delivery opening 24*a*, the validation control unit 60 issues a driving termination instruction to the delivery flapper driving mechanism 24*d*. As a result, the delivery opening 24*a* gets closed by the delivery flapper 24.

Meanwhile, if the discrimination signal received by the validation control unit 60 from the discriminating unit 50 indicates that the coin is a counterfeit coin, then the validation control unit 60 does not issue a driving instruction to the delivery flapper driving mechanism 24*d* so that the delivery opening is kept closed by the delivery flapper 24.

As a result, the coin that has passed across the discrimination area and that is carried toward the posterior side while being pressed by the pressure-carrying members 23 passes across the top face of the delivery flapper 24, slides on the temporarily retaining portion 33*a* and the front-end portion 33*c* of the temporarily retaining lever 33*b*, and falls down through the counterfeit-coin through hole 25 as illustrated in FIG. 15. The coin that has fallen down in that manner is stacked in the horizontally-fallen state in the base portion 20*a*3 of the carrying device main body 20*a*.

Meanwhile, as a result of the rotation of the carrier pulleys 21, the lower portion of the carrier belts 22 gets displaced toward the anterior side. Hence, on the lower side of the validated-coin carrying unit 20, the pressure-carrying members 23 fixed to the carrier belts 22 move toward the anterior side, thereby making it possible for the pressure-carrying members 23 to carry the coin that has been stacked in the base portion 20*a*3 toward the anterior side while keeping the coin pressed. At that time, in the pressure-carrying members 23, since the face 23*c* approaching the downstream side of the direction of displacement of the carrier belts 22 is a V-shaped face, the coin can be carried toward the posterior side while keeping it close to the middle portion in the right-left direction. In this way, the validated-coin carrying unit 20 delivers the anteriorly-carried coin (the counterfeit coin) to a drive-out unit 3 (see FIG. 2). In the drive-out unit 3, a drive-out belt 3*b* is stretched in an endless manner between a pair of right-left drive-out pulleys 3*a*. When the right-side drive-out pulley 3*a* rotates due to the driving of a drive-out motor 3*c*, the drive-out unit 3 delivers the coin driven out thereto to a disbursement unit 4, so that the coin is driven out to the outside through a coin drive-out opening 4*a* provided in the disbursement unit 4.

Figure 20:
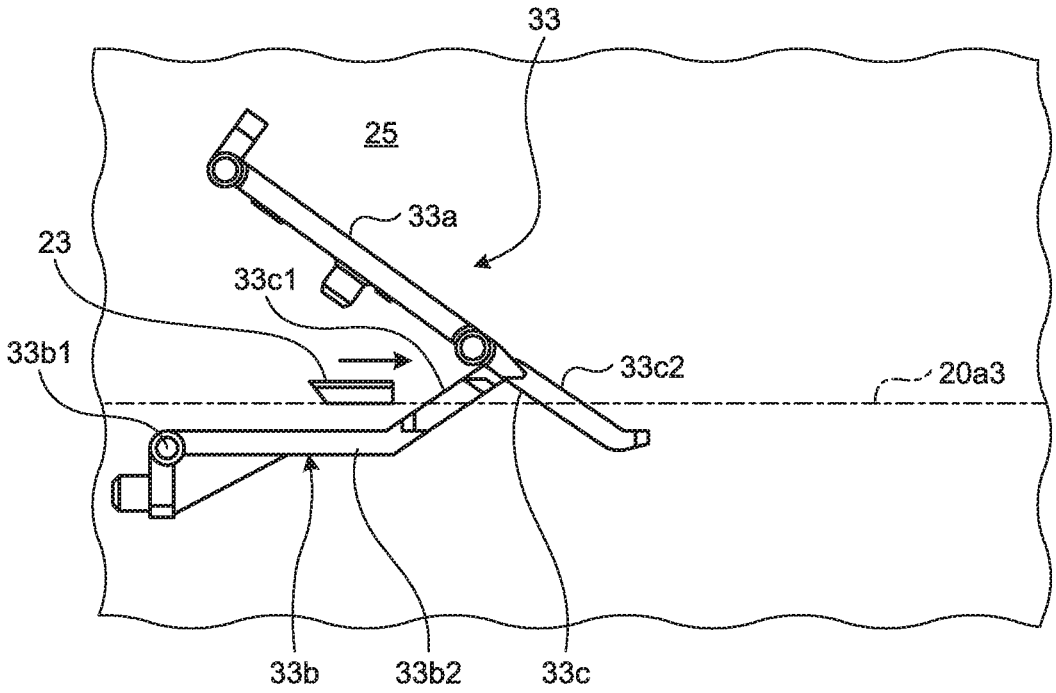
FIG. 20 is an explanatory diagram illustrating an action of the temporarily retaining mechanism illustrated in FIGS. 13 and 14.
Figure 21:
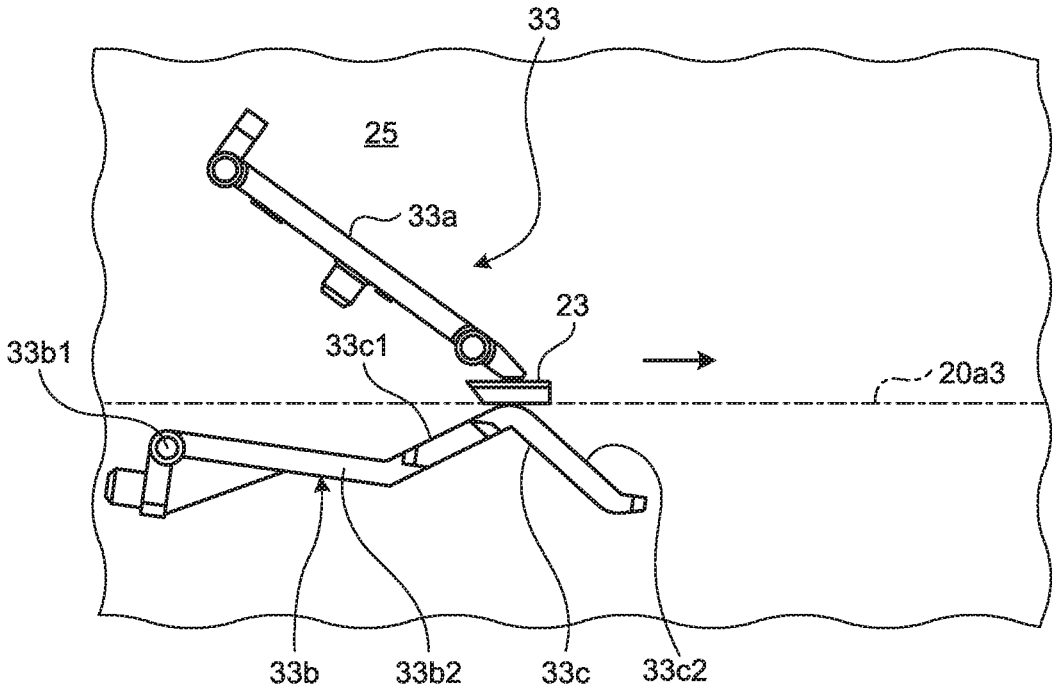
FIG. 21 is an explanatory diagram illustrating an action of the temporarily retaining mechanism illustrated in FIGS. 13 and 14.

Meanwhile, the front-end portion 33*c* of the temporarily retaining lever 33*b* is moved into the upper area of the base portion 20*a*3 through a lever opening 20*a*6. On the front-end portion 33*c* of the temporarily retaining lever 33*b*, the first inclined surface 33*c*1 is formed, whereby when the pressure-carrying members 23 moving toward the anterior side abuts thereagainst as illustrated in FIG. 20, the temporarily retaining lever 33*b* swings downward against the biasing force of the lever spring 33*d* so that the front-end portion 33*c* moves out from the upper area of the base portion 20*a*3 as illustrated in FIG. 21, allowing the pressure-carrying members 23 to move toward the anterior side.

Figure 22:
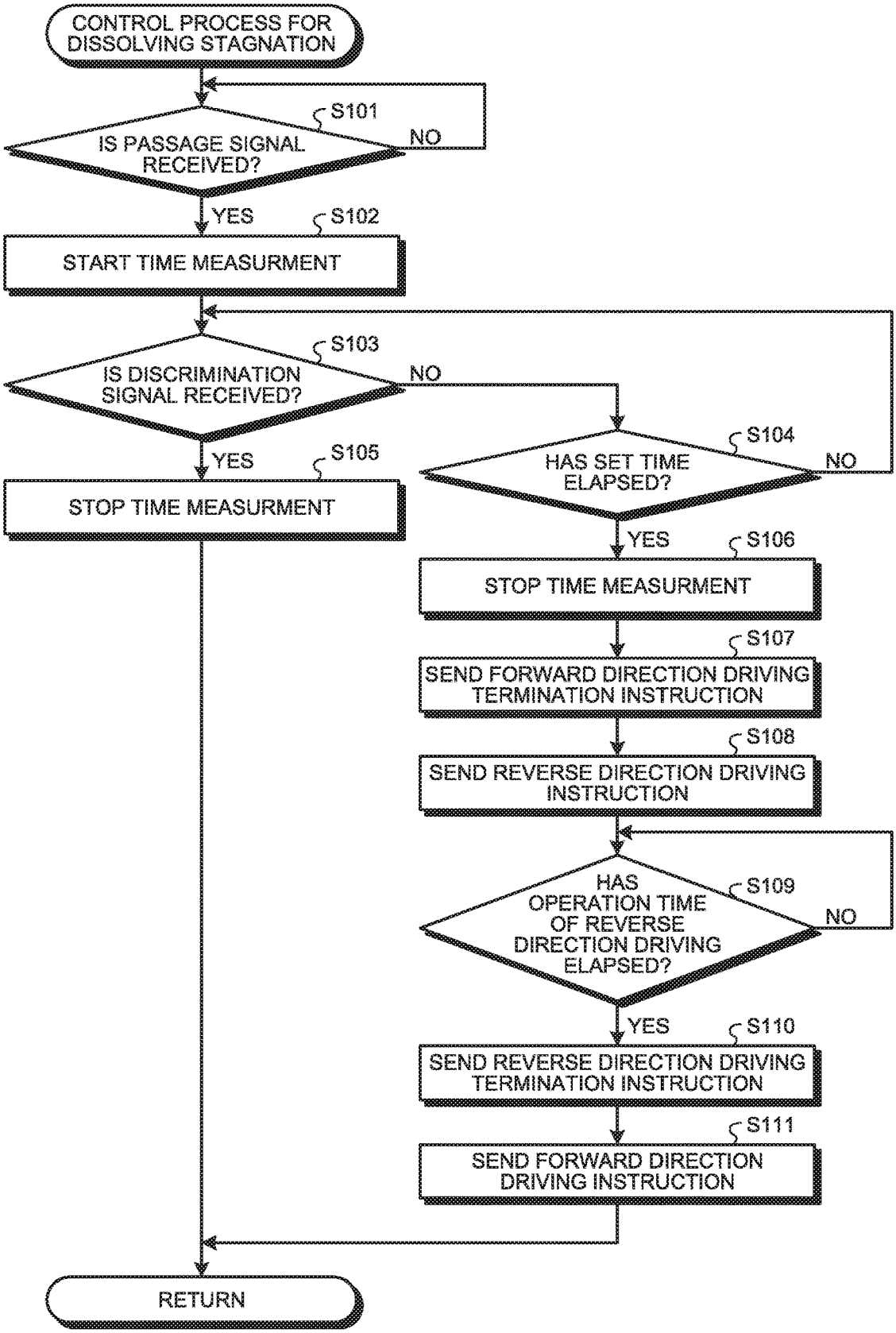
FIG. 22 is a flow chart illustrating a control process of dissolving stagnation executed by a validation control unit of FIG. 5.

FIG. 22 is a flow chart illustrating the processing of a control process for dissolving stagnation executed by the validation control unit 60 illustrated in FIG. 5. The following explains the control process for dissolving stagnation and also explains the operation of the coin validation device 10*a*. As the premise for the explanation on the control process for dissolving stagnation, the validation carrier motor 21*c* drives in the forward direction.

In the control process for dissolving stagnation, the validation control unit 60, when receiving the passage signal from the passage sensor 46 (Step S101: Yes), starts time measurement using an embedded clock (Step S102), and awaits input of the discrimination signal from the discriminating unit 50 until predetermined set time has elapsed (Step S103, Step S104).

If the discrimination signal is received before elapsing the set time (Step S103: Yes, Step S104: No), the validation control unit 60 stops the time measurement (Step S105), and then returns the processing to terminate the current processing.

By contrast, if the discrimination signal is not received before elapsing the set time (Step S103: No, Step S104: Yes), the validation control unit 60 determines that malfunctioning such as clogging of the coins has happened, stops the time measurement (Step S106), and sends a forward direction driving termination instruction to the validation carrier motor 21*c* (Step S107).

Next, the validation control unit 60 sends a reverse direction driving instruction to the validation carrier motor 21*c* (Step S108).

By sending the reverse direction driving instruction to the validation carrier motor 21*c*, the validation carrier motor 21*c* drives in the reverse direction, and thus, in the validated-coin carrying unit 20, the carrier pulleys 21 rotate in the clockwise direction, when viewed from the left-hand side, so that the carrier belts 22 get displaced along the direction of extension. Moreover, as a result of rotation of the carrier pulleys 21, the rotating body 42 of the validated-coin separating unit 40 rotates, via the driving force transmitting unit 44, in the counterclockwise direction when viewed from above. As a result, stagnation due to clogging of the coins or other reasons can be dissolved.

Then, when the validation carrier motor 21*c* drives in the reverse direction, the lower portion of the carrier belts 22 gets displaced toward the anterior side. On the lower side of the validated-coin carrying unit 20, the pressure-carrying members 23 fixed to the carrier belts 22 move toward the posterior side, whereby the pressure-carrying members 23 carries the coin that has been stacked in the base portion 20*a*3 toward the posterior side while keeping the coin pressed.

Figure 23A:
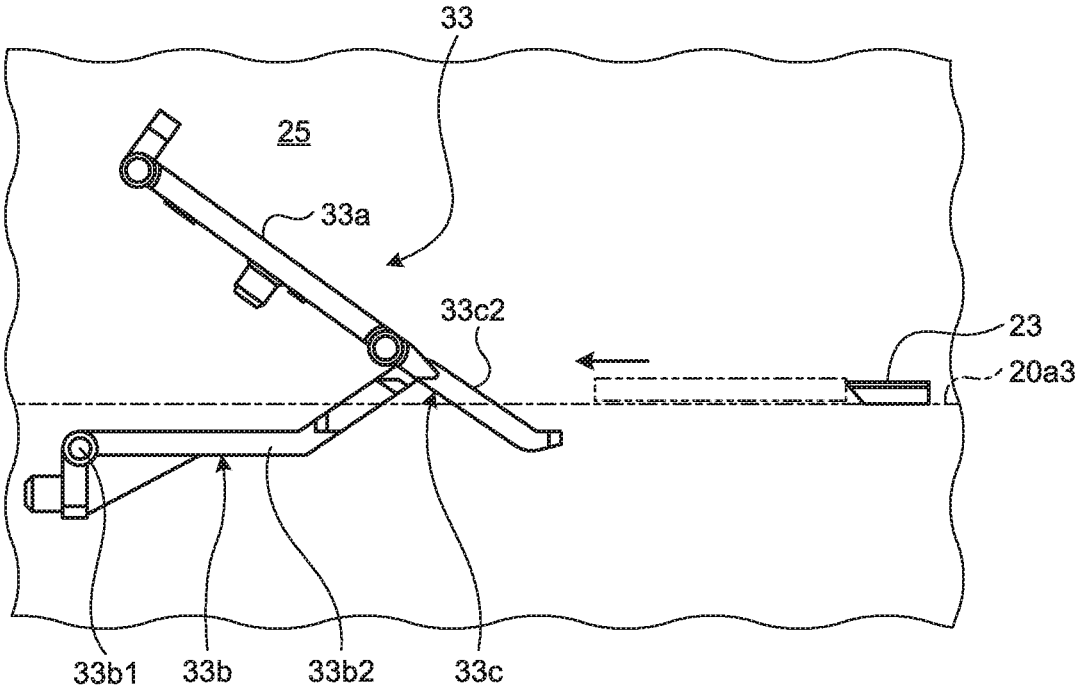
FIG. 23A is an explanatory diagram illustrating an action of the temporarily retaining mechanism illustrated in FIGS. 13 and 14.
Figure 23B:
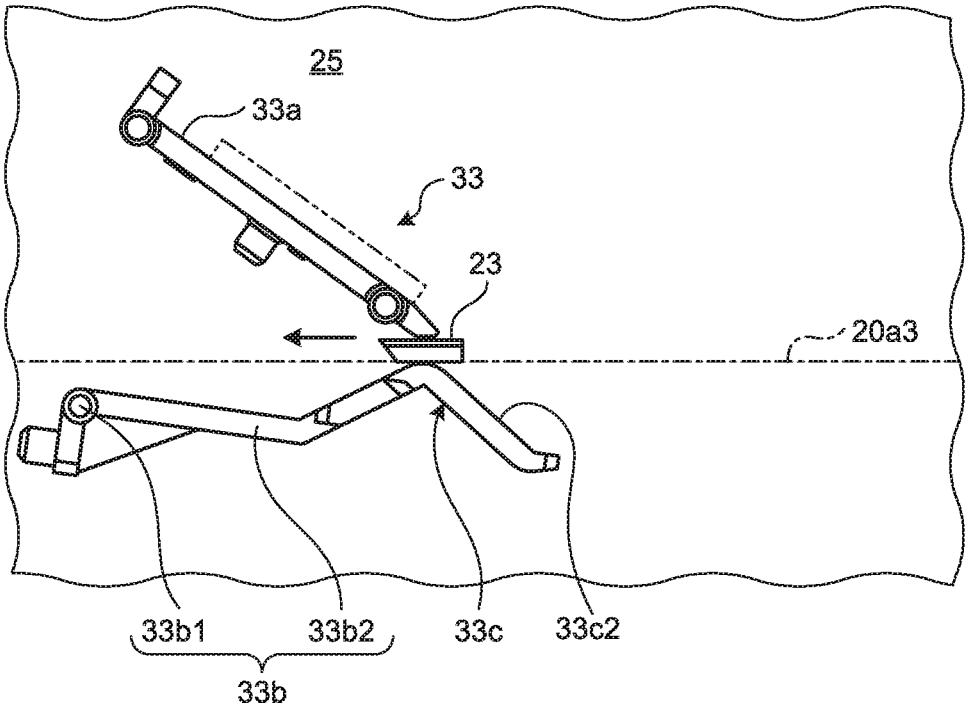
FIG. 23B is an explanatory diagram illustrating an action of the temporarily retaining mechanism illustrated in FIGS. 13 and 14.

Meanwhile, the front-end portion 33*c* of the temporarily retaining lever 33*b* is moved into the upper area of the base portion 20*a*3 through the lever opening 20*a*6. On the front-end portion 33*c* of the temporarily retaining lever 33*b*, the second inclined surface 33*c*2 is formed, thereby guiding a coin being carried to the posterior side to the temporarily retaining portion 33*a* as illustrated in FIG. 23(*a*). Furthermore, as illustrated in FIG. 23(*b*), when the pressure carrying members 23 moving to the posterior side abuts thereagainst, the temporarily retaining lever 33*b* swings downward against the biasing force of the lever spring 33*d* so that the front-end portion 33*c* moves out from the upper area of the base portion 20*a*3, allowing the pressure-carrying members 23 to move toward the posterior side. Hence, in the operation of dissolving stagnation, coins can be retained in the temporarily retaining mechanism 33. That enables achieving prevention of new clogging of the coins in the validated-coin carrying unit 20.

The validation control unit 60 that sent a reverse direction driving instruction to the validation carrier motor 21*c* in that manner awaits the elapse of operation time of the reverse direction driving (Step S109). The operation time of the reverse direction driving is long enough to dissolve malfunctions such as clogging of the coins.

When the operation time of the reverse direction driving has elapsed (Step S109: Yes), the validation control unit 60 sends a reverse direction driving termination instruction to the validation carrier motor 21*c* (Step S110) and sends the forward direction driving instruction to the validation carrier motor 21*c* (Step S111), and then returns the processing to terminate the current processing.

Hence, malfunctioning such as clogging of coins in the validated-coin carrying unit 20 or validated-coin separating unit 40 can be dissolved.

As described above, the coin validation device 10*a* identifies the authenticity and the denominations of the coins deposited from the depositing port 2; and sends the coins discriminated as authentic to the coin carrying device 10*b* but drives out the coins discriminated as counterfeit coins to the outside via the disbursement unit 4.

In the coin validation device 10*a*, regarding the coins that are carried toward the posterior side and that are discriminated as counterfeit coins by the discriminating unit 50, the validated-coin carrying unit 20 carries such coins toward the anterior side after making them pass through the counterfeit-coin through hole 25. Hence, the length in the front-back direction of the validated-coin carrying unit 20 can be shortened, thereby enabling achieving downsizing of the coin handling machine 1.

In the coin validating device 10*a*, in the pressure-carrying members 23 constituting the validated-coin carrying unit 20, the face 23*c* that presses the coins due to displacement of the carrier belts 22 is a V-shaped face, and thus the coins can be carried while keeping them close to the middle portion in the right-left direction. As a result, not only the coins can be stably carried while restricting the carrying position thereof, but the accuracy of discrimination performed by the discriminating unit 50 can also be enhanced.

Coin Carrying Device

Figure 24:
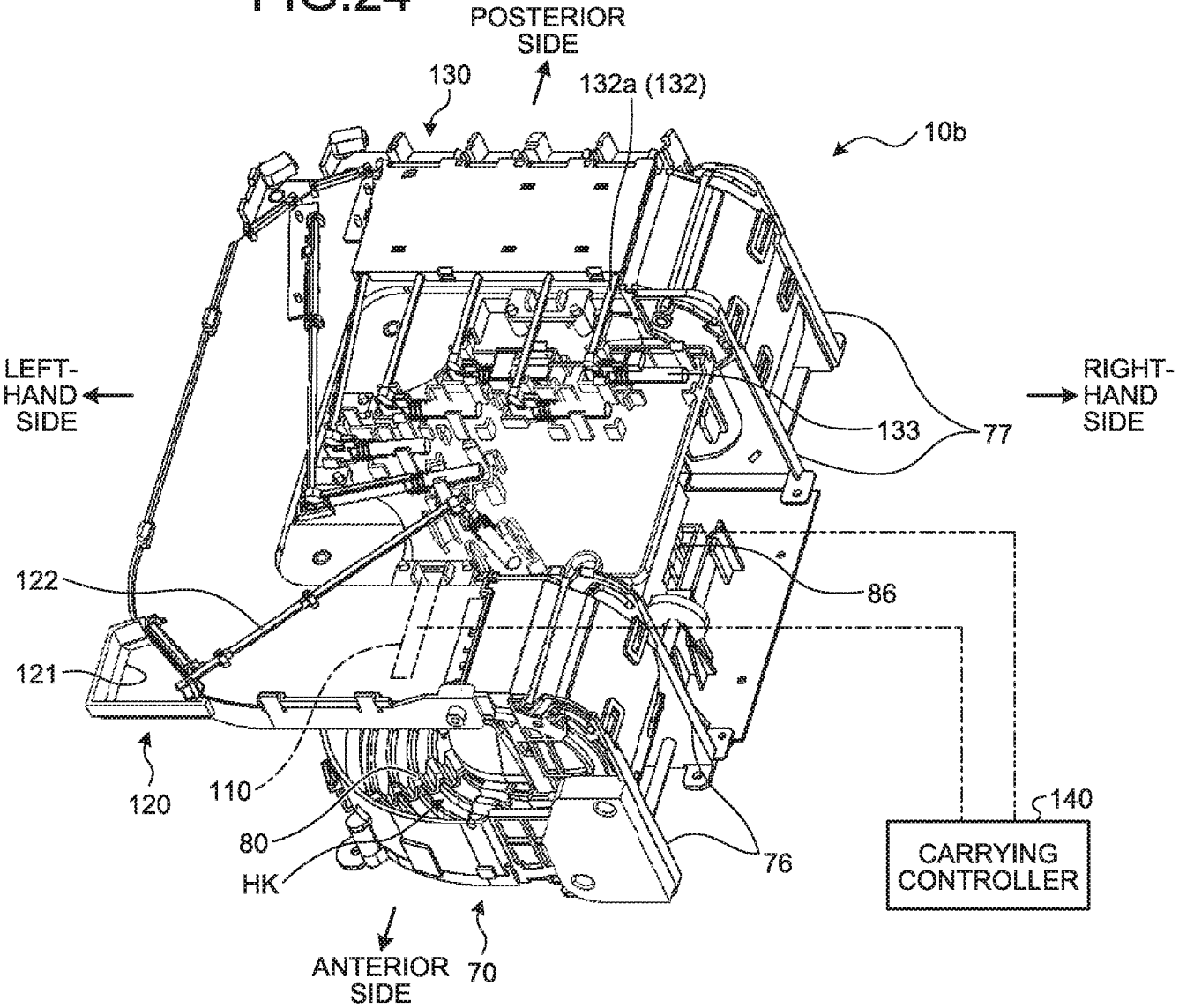
FIG. 24 is a perspective view of a coin carrying device of FIG. 1.
Figure 25:
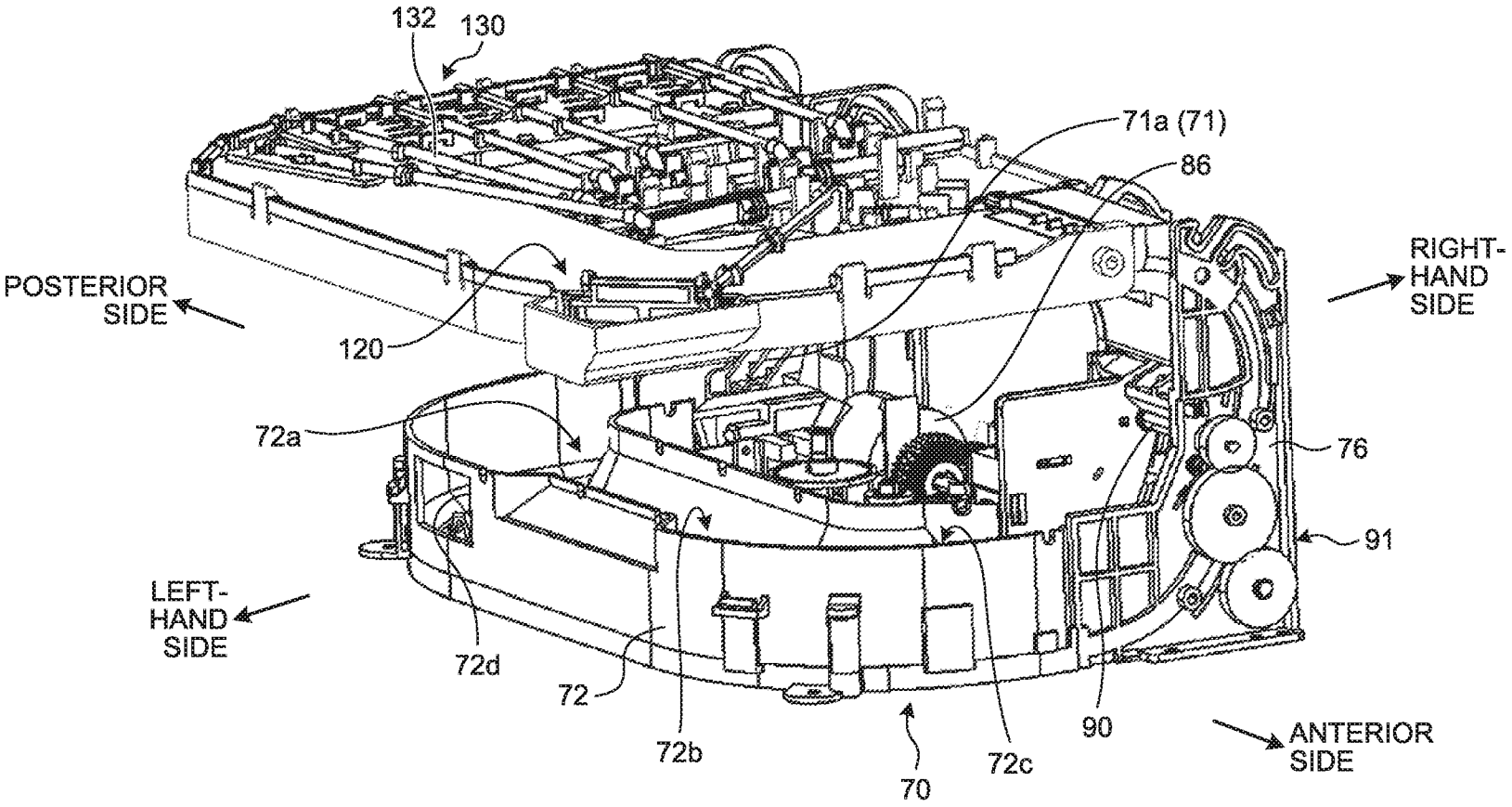
FIG. 25 is a perspective view illustrating, with omission of some constituent elements, the coin carrying device of FIG. 24.
Figure 26:
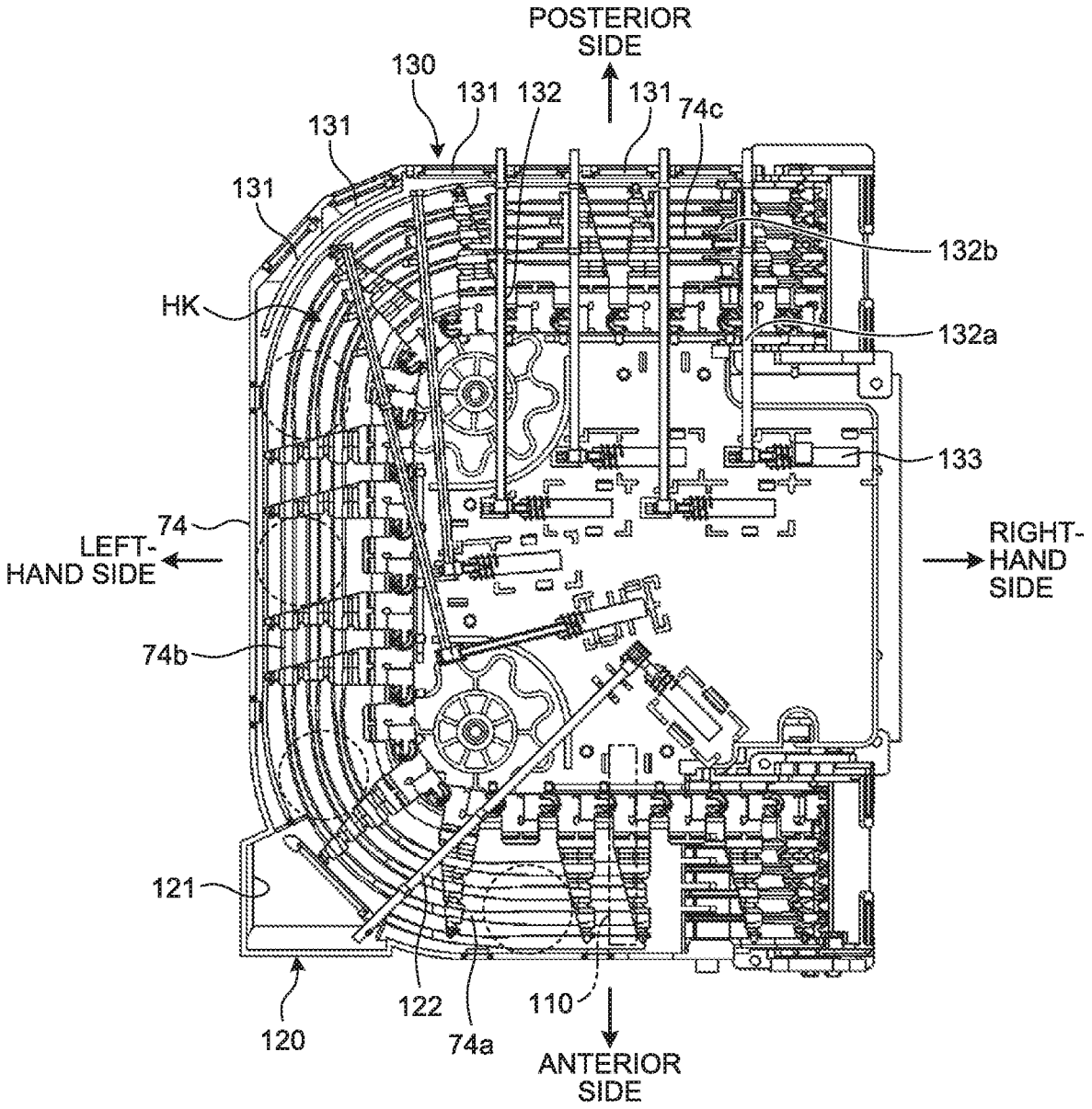
FIG. 26 is a planar view illustrating, with omission of some constituent elements, the coin carrying device of FIG. 24.
Figure 27:
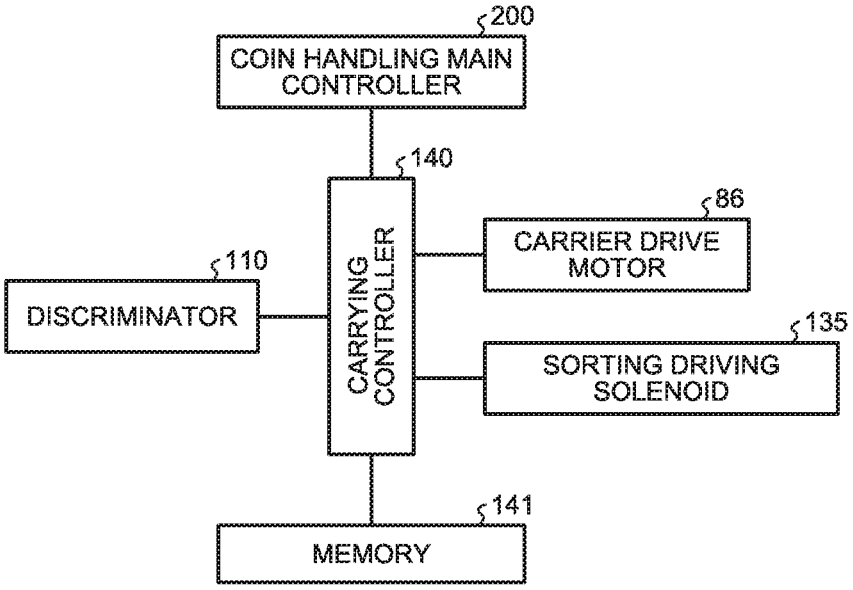
FIG. 27 is a block diagram that schematically illustrates a characteristic control system of the coin carrying device illustrated in FIGS. 24 and 25.

FIG. 24 is a perspective view of the coin carrying device 10*b* illustrated in FIG. 1. FIG. 25 is a perspective view illustrating, with omission of some constituent elements, the coin carrying device 10*b* illustrated in FIG. 24. FIG. 26 is a planar view illustrating, with omission of some constituent elements, the coin carrying device 10*b* illustrated in FIG. 24. FIG. 27 is a block diagram that schematically illustrates the characteristic control system of the coin carrying device 10*b* illustrated in FIGS. 24 and 25.

The coin carrying device 10*b* illustrated in the drawings carries coins for which authenticity and denomination identification has been done in the coin validation device 10*a*; determines the denomination of each coin while carrying that coin; and sorts the coins according to the denominations before delivering them to a coin container 5 (see FIG. 1). The coin container 5 is used to store the coins, which have been sorted by the coin carrying device 10*b*, based on the denominations and, when a disbursement instruction is received, delivers the relevant coins to the disbursement unit 4 and pays out the coins to the outside through the disbursement unit 4.

The coin carrying device 10*b* includes a rail portion 70, a carrying unit 80, a reverse roller 90, a discriminating unit 110, a returning unit 120, a sorting unit 130, and a carrying unit (a controller) 140.

Figure 28:
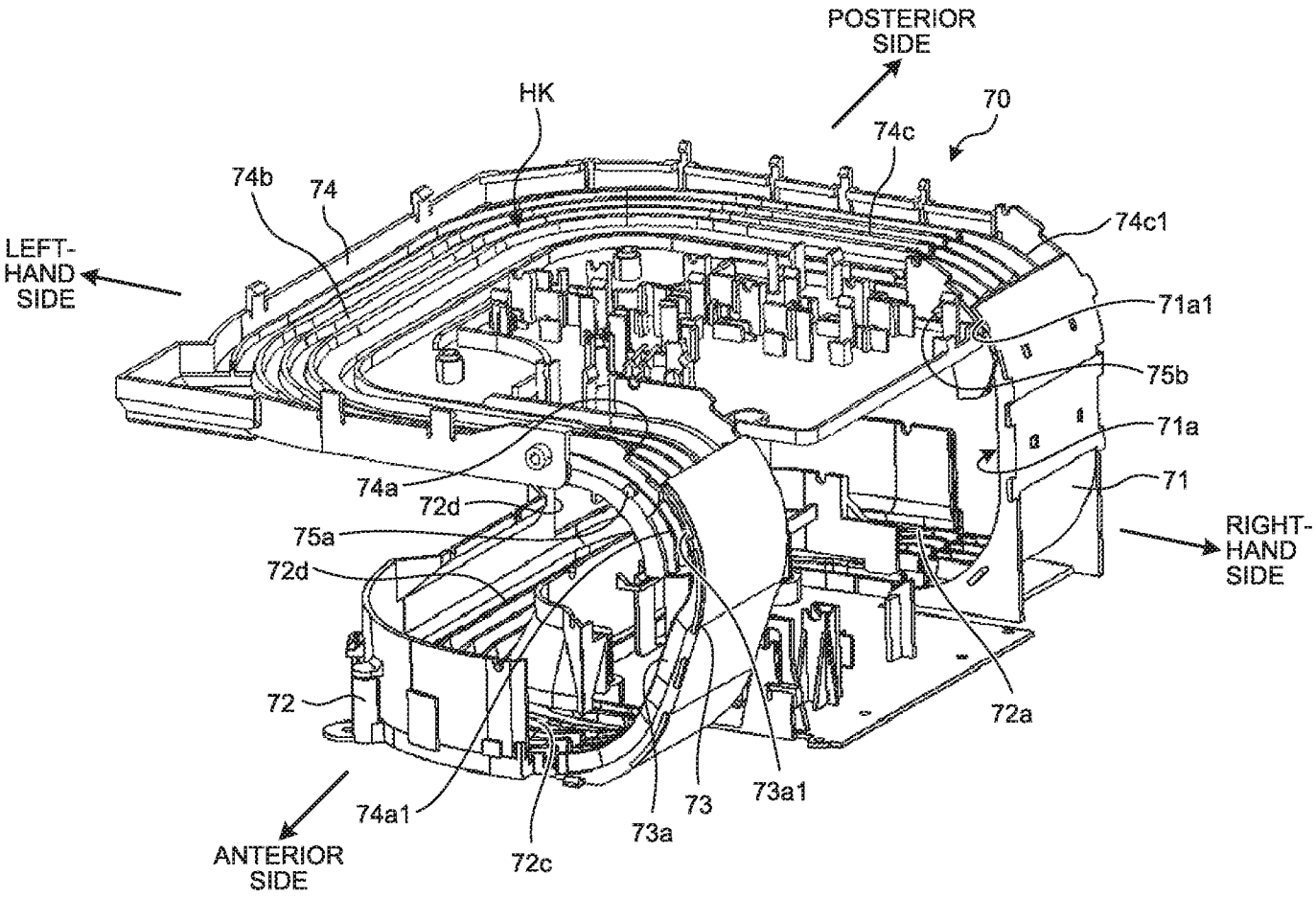
FIG. 28 is a perspective view of a rail portion illustrated in FIGS. 24 and 25.

As illustrated in FIG. 28 too, the rail portion 70 includes a first rail forming member 71, a second rail forming member 72, a third rail forming member 73, and a fourth rail forming member 74.

The first rail forming member 71 constitutes a carrying pathway HK on the right-hand posterior side in the coin carrying device 10*b*. The first rail forming member 71 has a curved downward-extending portion 71*a* that is raised in the posterior side and that curves downward. That is, the first rail forming member 71 has a descending portion that extends downward in a curved manner.

The second rail forming member 72 constitutes the carrying pathway HK in the lower part in the coin carrying device 10*b*. The second rail forming member 72 includes a first leftward-extending portion 72*a*, an anterior-extending portion 72*b*, and a first rightward-extending portion 72*c*.

The first leftward-extending portion 72*a* is continuous with the curved downward-extending portion 71*a* of the first rail forming member 71, and extends toward the left-hand side. The anterior-extending portion 72*b* extends toward the anterior side of the extending end of the first leftward-extending portion 72*a*. The first rightward-extending portion 72*c* extends toward the right-hand side from the extending end of the anterior-extending portion 72*b*. In the second rail forming member 72, an inserting slot 72*d* is formed in which coins discriminated as authentic by the coin validation device 10*a* are inserted.

The third rail forming member 73 constitutes the carrying pathway HK on the right-hand anterior side in the coin carrying device 10*b*. The third rail forming member 73 is continuous with the first rightward-extending portion 72*c* in the second rail forming member 72 and has a curved upward-extending portion 73*a* that is raised in the posterior side and that curves upward. That is, the third rail forming member 73 has an ascending portion that extends upward in a curved manner.

The fourth rail forming member 74 constitutes the carrying pathway HK in the upper part in the coin carrying device 10*b*. The fourth rail forming member 74 includes a second leftward extending portion 74*a*, a rearward-extending portion 74*b*, and a second rightward-extending portion 74*c*.

The second leftward-extending portion 74*a* extends toward the left-hand side. The second leftward-extending portion 74*a* has a right-end portion 74*a*1 that is curved to face an upper-end portion 73*a*1 of the curved upward-extending portion 73*a* of the third rail forming member 73. The rearward-extending portion 74*b* extends toward the posterior side of the extending end of the second leftward-extending portion 74*a*. The second rightward-extending portion 74*c* extends toward the right-hand side from the extending end of the rearward-extending portion 74*b*. The second rightward-extending portion 74*c* has a right-end portion 74*c*1 that is curved to face an upper-end portion 71*a*1 of the curved downward-extending portion 71*a* of the first rail forming member 71.

Thus, in the rail portion 70, the endless carrying pathway HK is formed as a result of sequentially and continuously arranging the first rail forming member 71, the second rail forming member 72, the third rail forming member 73, and the fourth rail forming member 74.

Figure 29:
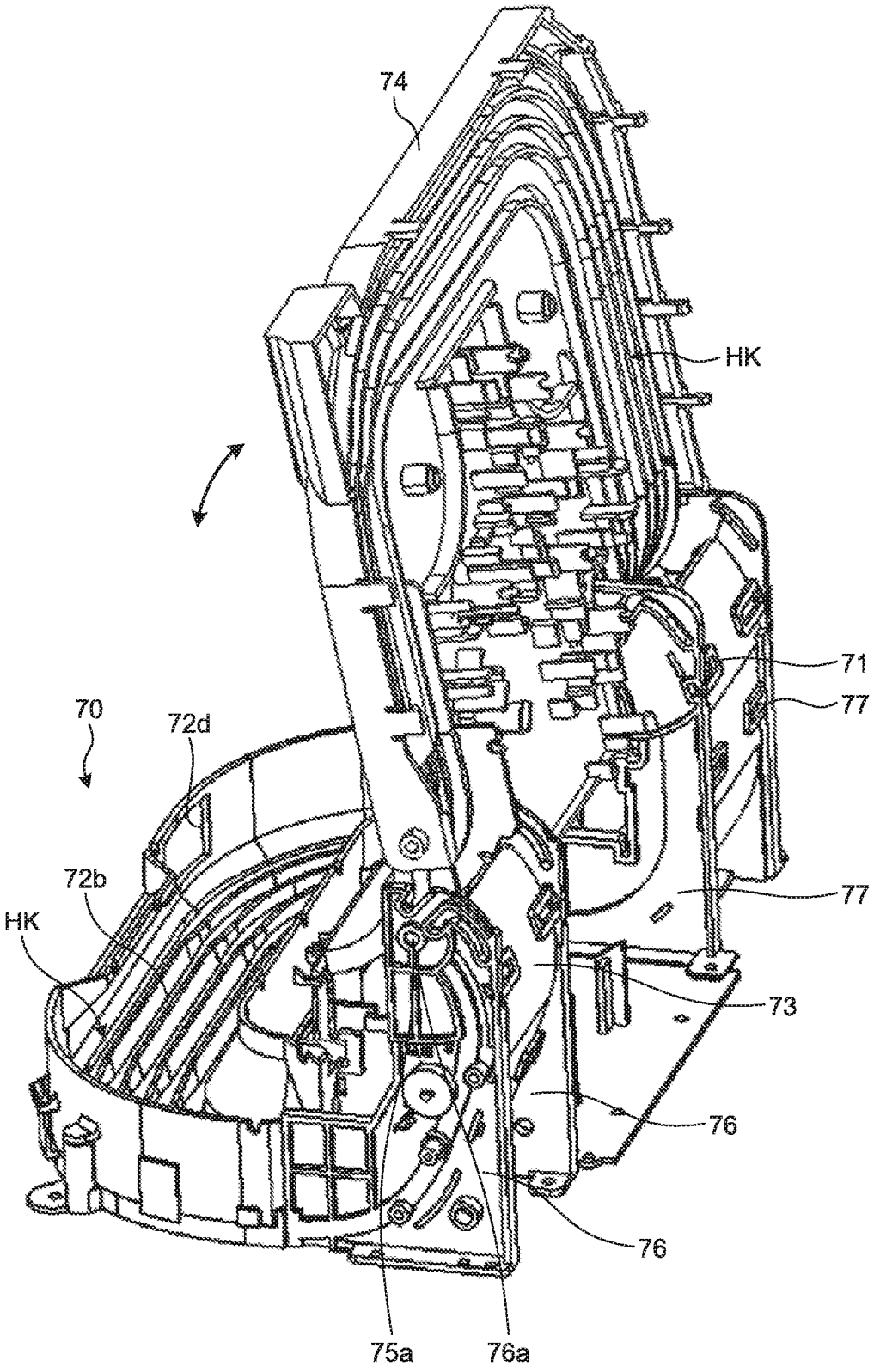
FIG. 29 is a perspective view of a rail portion illustrated in FIGS. 24 and 25.

Moreover, in the fourth rail forming member 74 of the rail portion 70, a first projecting portion 75*a* that is formed on the right-end portion 74*a*1 of the second leftward-extending portion 74*a* passes through a first bearing hole 76*a* formed on a first supporting plate 76 that supports the third rail forming member 73 by sandwiching it in the anteroposterior direction, and a second projecting portion 75*b* that is formed on the right-end portion 74*c*1 of the second rightward-extending portion 74*c* passes through a second bearing hole (not illustrated) formed on a second supporting plate 77 that supports the first rail forming member 71 by sandwiching it in the anteroposterior direction. The first projecting portion 75*a* and the second projecting portion 75*b* have the central shafts thereof coincident with each other. Hence, the fourth rail forming member 74 is swingable by, for example, about 60° around the central shafts of the first projecting portion 75*a* and the second projecting portion 75*b*. That is, as illustrated in FIG. 29, the fourth rail forming member 74 becomes swingable in the vertical direction around the central shafts of the first projecting portion 75*a* and the second projecting portion 75*b*.

Figure 30:
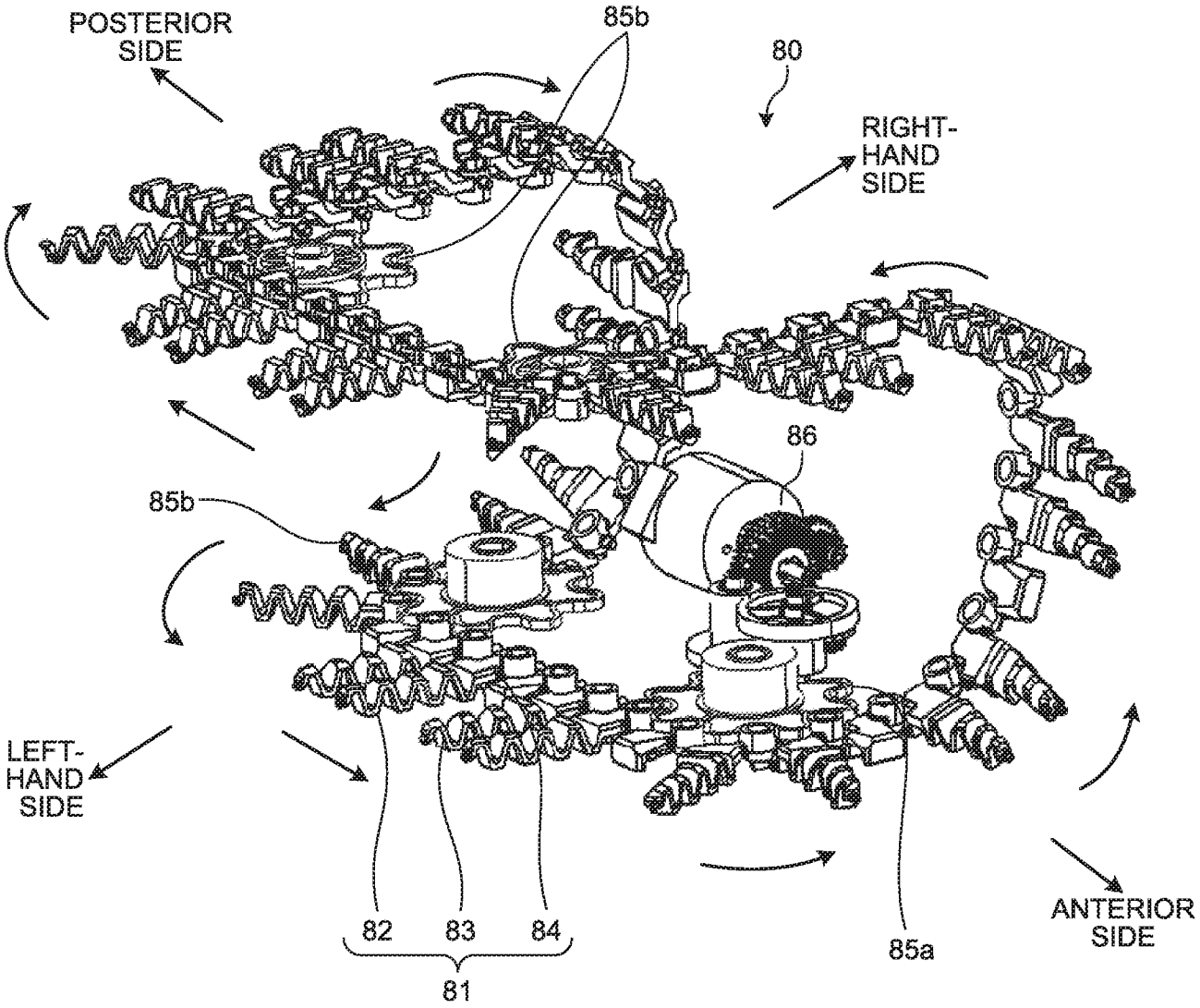
FIG. 30 is a perspective view of a carrier that constitutes the coin carrying device illustrated in FIG. 24.

FIG. 30 is a perspective view of the carrying unit (carrier) 80 that constitutes the coin carrying device 10*b* illustrated in FIG. 24. As is illustrated in FIG. 30, the carrying unit 80 is formed by interlinking a plurality of holding parts 81 in an endless manner.

Some portion of the carrying unit 80 engages with a driving carrier pulley 85*a* and a plurality of (in the example illustrated in FIG. 22, three) driven carrier pulleys 85*b*. The driving carrier pulley 85*a* rotates when driven by a carrier drive motor 86, and gets displaced along the carrying pathway HK.

The carrier drive motor 86 is driven when a driving instruction is received from the carrying control unit 140, and is capable of forward-reverse rotation driving. When the carrier drive motor 86 performs driving in the forward direction, the rail portion 70 is displaced in such a way that each holding part 81 of the carrying unit 80 moves in one direction that is along the first rail forming member 71, the second rail forming member 72, the third rail forming member 73, and the fourth rail forming member 74 in that order.

On the other hand, when the carrier drive motor 86 performs driving in the reverse direction, the rail portion 70 is displaced in such a way that each holding part 81 of the carrying unit 80 moves in an opposite direction that is along the fourth rail forming member 74, the third rail forming member 73, the second rail forming member 72, and the first rail forming member 71 in that order.

Considering the configuration of the carrying pathway HK, in the carrying unit 80, the holding parts 81 passing across the second rail forming member 72 have the reversed orientation in the vertical direction with respect to the holding parts 81 passing across the fourth rail forming member 74.

Figure 31:
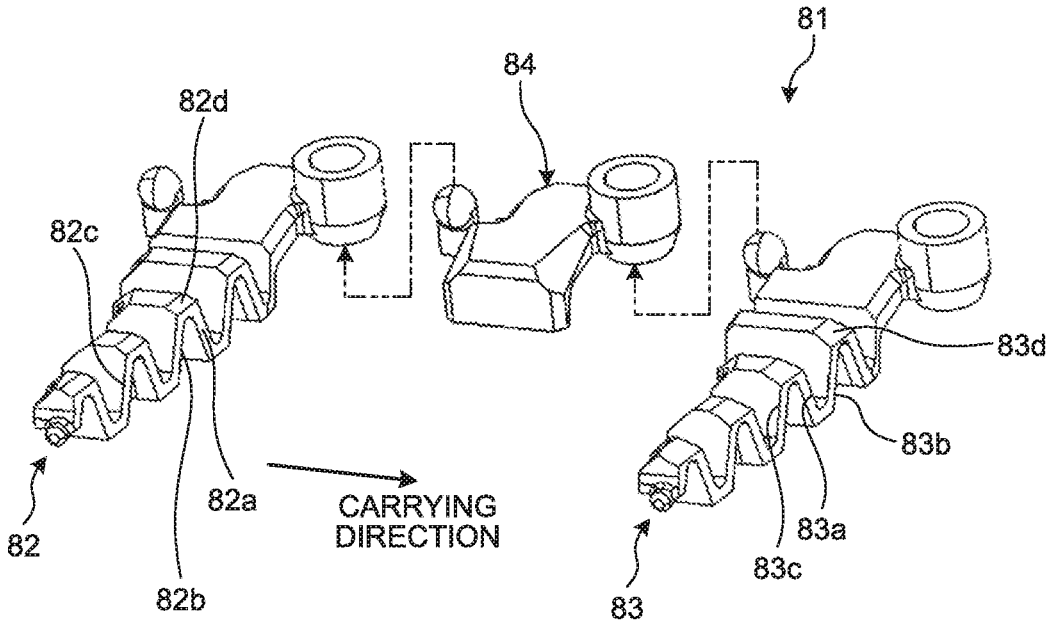
FIG. 31 is an explanatory exploded diagram illustrating the constituent elements of a holding part of FIG. 30.

Each holding part 81 representing the constituent elements of the carrying unit 80 holds one coin at a time and, as illustrated in FIG. 31, is configured by interlinking a hold-pressing member 82 and a hold-regulating member 83 using a hold-interlinking member 84.

The hold-pressing member 82 is a rod-like member extending from the inside toward the outside of the carrying pathway HK. The hold-pressing member 82 presses the coin toward the downstream side of the carrying pathway HK due to the displacement of the carrying unit 80, and has a pressing face 82*a* that approaches the downstream side of the carrying pathway HK and that is gradually tilted to the upstream side when moving from inward to outward.

Figure 32:
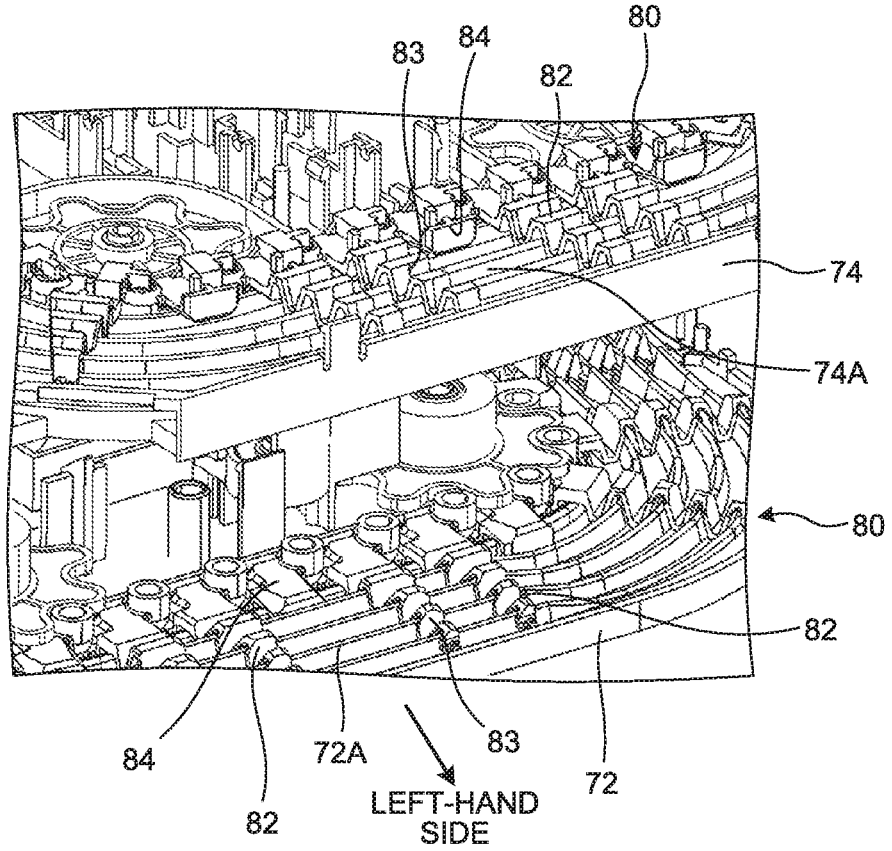
FIG. 32 is an enlarged perspective view illustrating main components of a second rail forming member and a fourth rail forming member.
Figure 33:
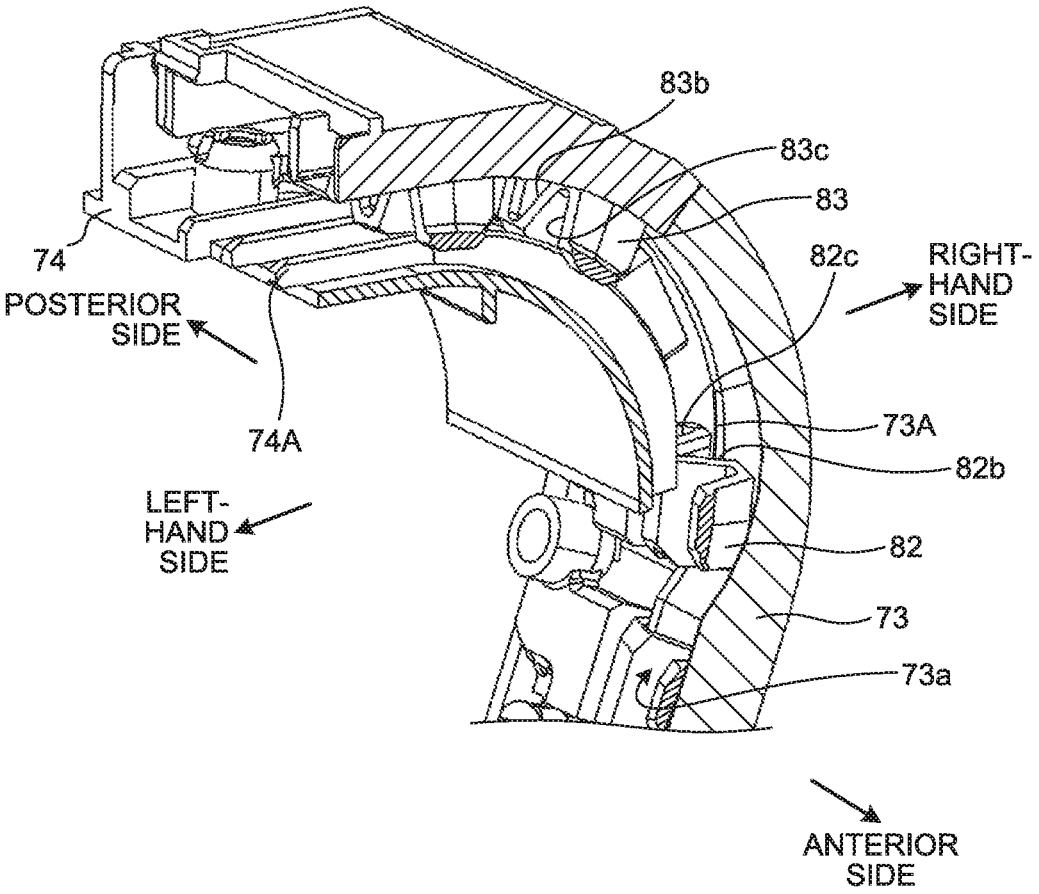
FIG. 33 is an enlarged cross-sectional view illustrating the mutually-facing portion between the upper end of a curved upward-extending portion of a third rail forming member and the right end of a second leftward-extending portion of a fourth rail forming member.

As illustrated in FIGS. 32 and 33, the hold-pressing member 82 includes a first depression 82*b* that allows entry therein of a rail salient portion 71A formed on the first rail forming member 71, a rail salient portion 72A formed on the second rail forming member 72, and a rail salient portion 73A formed on the third rail forming member 73; and includes a second depression 82*c* that allows entry therein of a rail salient portion 74A formed on the fourth rail forming member 74. Moreover, on the pressing face 82*a* present in the bottom portion of the first depression 82*b*, an inclined surface 82*d* is formed.

The hold-regulating member 83 has an identical configuration to the configuration of the hold-pressing member 82, and is a rod-like member extending from the inside toward the outside of the carrying pathway HK. The inward side of the hold-regulating member 83 is interlinked with the hold-pressing member 82 via the hold-interlinking member 84; and regulates the coin, which is pressed by the hold-pressing member 82 due to the displacement of the carrying unit 80 in the one direction, to ensure that the coin does not get separated from the hold-pressing member 82 more than necessary. Meanwhile, the inward side of the hold-regulating member 83 of the concerned holding part 81 is interlinked with the hold-pressing member 82 of the holding part 81 present on the downstream side of the concerned holding part 81.

In the hold-regulating member 83, a downstream face 83*a* approaches the downstream side of the carrying pathway HK and is gradually tilted to the upstream side when moving from inward to outward. The hold-regulating member 83 includes a third depression 83*b* that allows entry therein of the rail salient portion 71A formed on the first rail forming member 71, the rail salient portion 72A formed on the second rail forming member 72, and the rail salient portion 73A formed on the third rail forming member 73; and includes a fourth depression 83*c* that allows entry therein of the rail salient portion 74A formed on the fourth rail forming member 74. Moreover, on the downstream face 83*a* present in the bottom portion of the third depression 83*b*, an inclined surface 83*d* is formed.

As described above, the upper-end portion 73*a*1 of the curved upward-extending portion 73*a* of the third rail forming member 73 and the right-end portion 74*a*1 of the second leftward-extending portion 74*a* of the fourth rail forming member 74 are facing each other. Hence, as illustrated in FIG. 33, in each holding part 81 that passes across the concerned portion, the rail salient portion 73A of the third rail forming member 73 enters the first depression 82*b* of the hold-pressing member 82, and the rail salient portion 74A of the fourth rail forming member 74 enters the second depression 82*c* of the hold-pressing member 82. In an identical manner, the rail salient portion 73A of the third rail forming member 73 enters the third depression 83*b* of the hold-regulating member 83, and the rail salient portion 74A of the fourth rail forming member 74 enters the fourth depression 83*c* of the hold-regulating member 83.

Moreover, as described above, the upper-end portion 71*a*1 of the curved downward-extending portion 71*a* of the first rail forming member 71 and the right-end portion 74*c*1 of the second rightward-extending portion 74*c* of the fourth rail forming member 74 are facing each other. Hence, although not illustrated in the drawings, in each holding part 81 that passes across the concerned portion, the rail salient portion 71A of the first rail forming member 71 enters the first depression 82*b* of the hold-pressing member 82, and the rail salient portion 74A of the fourth rail forming member 74 enters the second depression 82*c* of the hold-pressing member 82. In an identical manner, the rail salient portion 71A of the first rail forming member 71 enters the third depression 83*b* of the hold-regulating member 83, and the rail salient portion 74A of the fourth rail forming member 74 enters the fourth depression 83*c* of the hold-regulating member 83.

Figure 34:
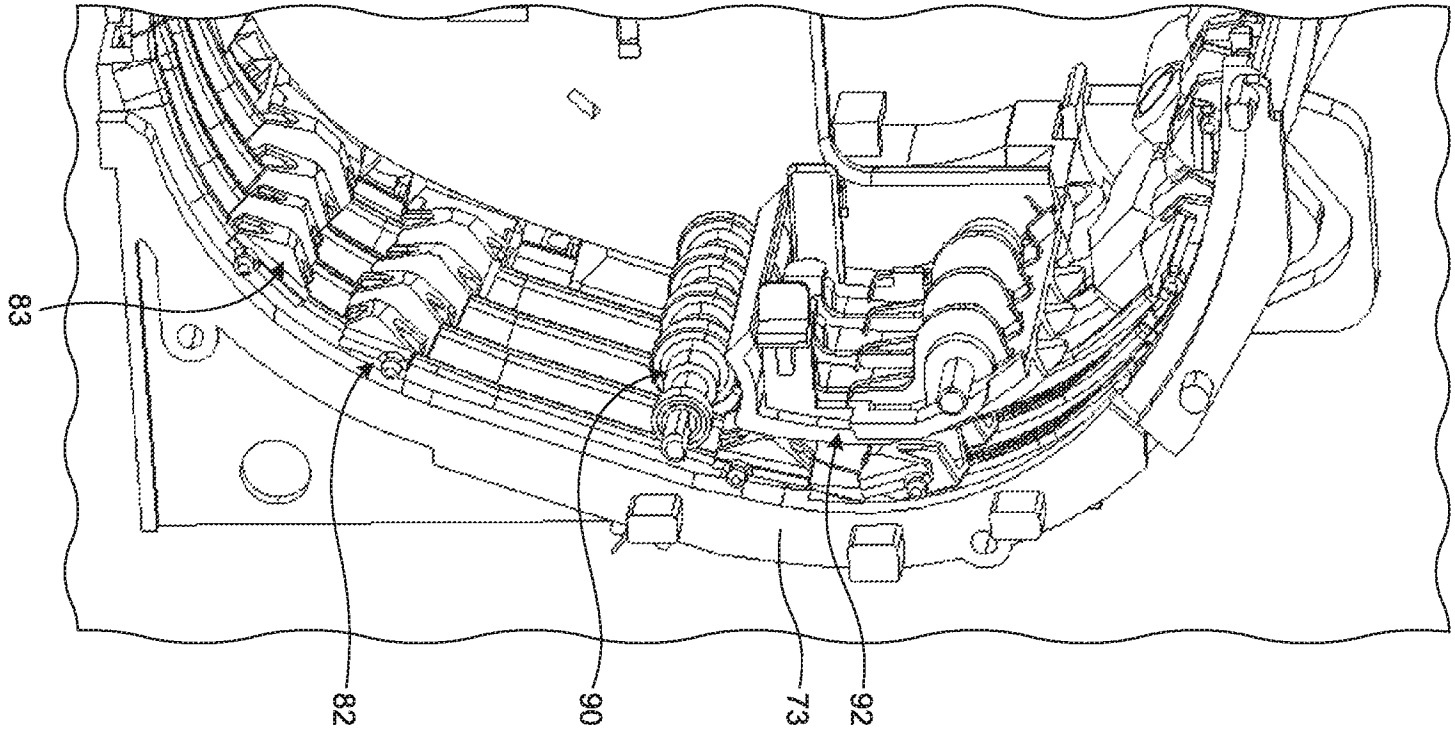
FIG. 34 is a perspective view illustrating a reverse roller and a carrier guide arranged on and opposed to the third rail forming member.

As illustrated in FIG. 34, the reverse roller 90 is rotatably installed on the first supporting plate 76 and faces the third rail forming member 73. Moreover, the reverse roller 90 is linked with the carrier drive motor 86 via a carrier linkage unit 91 (see FIG. 25), and rotates around the central shaft of itself due to the driving of the carrier drive motor 86.

Figure 35:
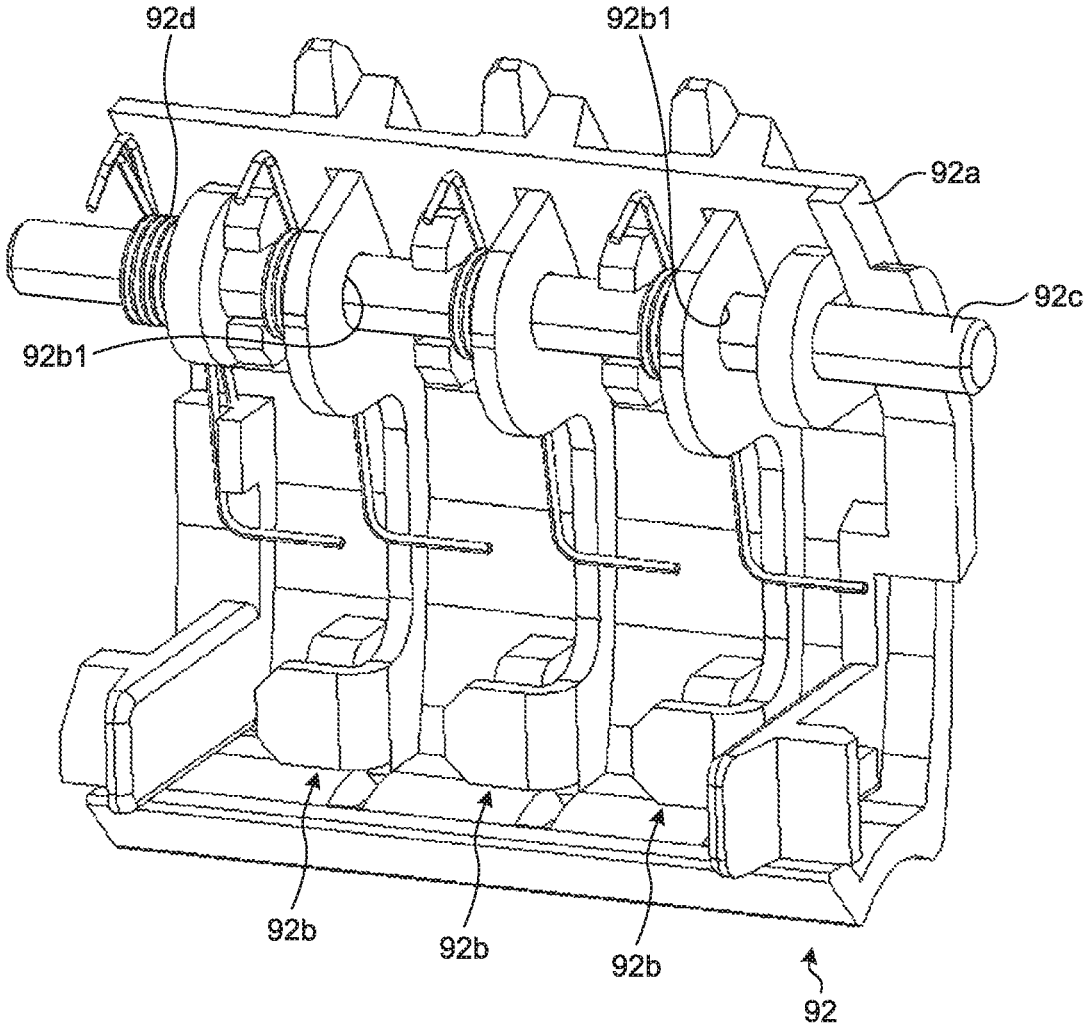
FIG. 35 is a perspective view of the carrier guide of FIG. 34.
Figure 36:
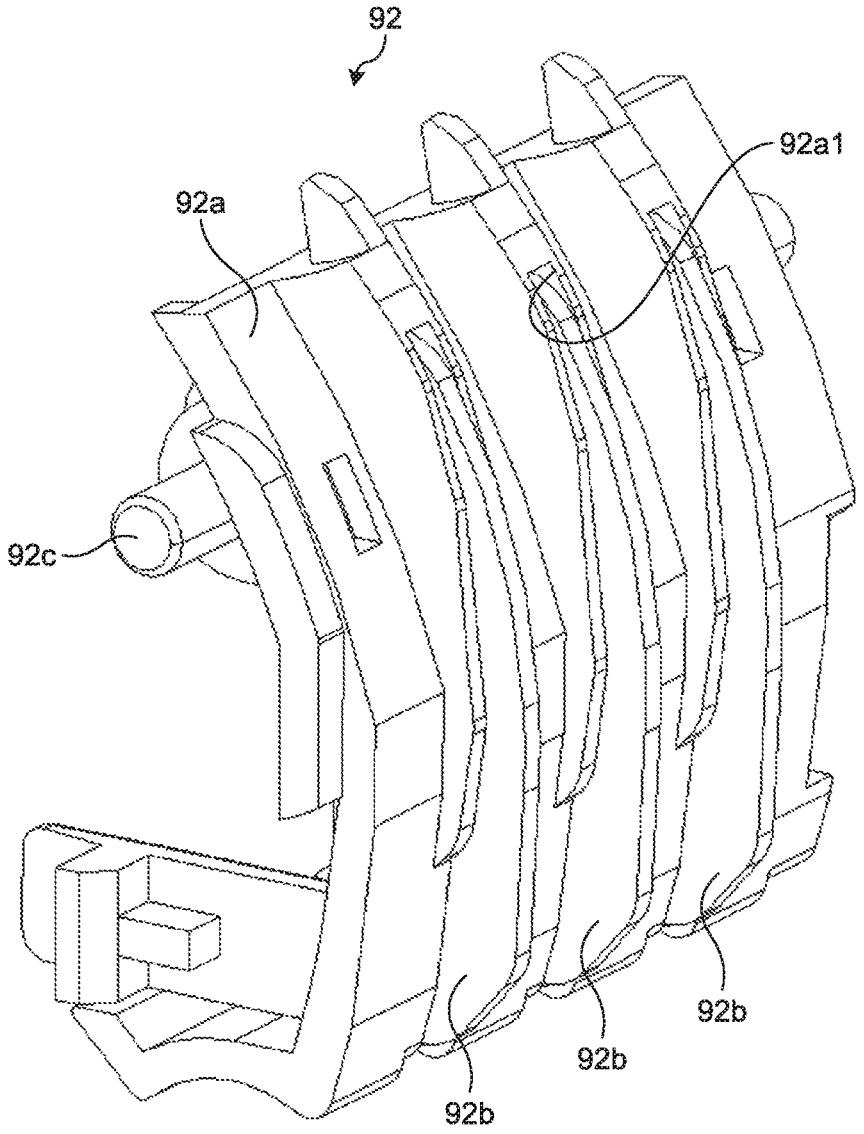
FIG. 36 is a perspective view of the carrier guide of FIG. 34.

In the upper area of the reverse roller 90, a carrier guide 92 is disposed to face the third rail forming member 73. As illustrated in FIG. 35 and FIG. 36, the carrier guide 92 includes a guide base portion 92*a* and a plurality guide levers 92*b*.

The guide base portion 92*a* is formed of synthetic resin and is provided on the first supporting plate 76. The guide lever 92*b* has a through hole 92*b*1 in the upper-end portion thereof, and a shaft-like portion 92*c* penetrates through the through hole 92*b*1, extending along the front-back direction, being supported on the guide base portion 92*a*. As a result, the guide lever 92*b* becomes swingable around the central shaft of the shaft-like portion 92*c*.

A lever spring 92*d* is interposed between the guide lever 92*b* and the guide base portion 92*a*. When the guide lever 92*b* is biased by the lever spring 92*d*, a part of the lower portion of the guide lever 92*b* gets close to the third rail forming member 78 through a lever opening 92*a*1 provided to the guide base portion 92*a*. Note that, the portion getting close to the third rail forming member 78 through the lever opening 92*a*1 has a thickness that allows the portion to penetrate into the second depression 82*c* of the hold-pressing member 82 and the fourth depression 83*c* of the hold-regulating member 83.

Figure 37:
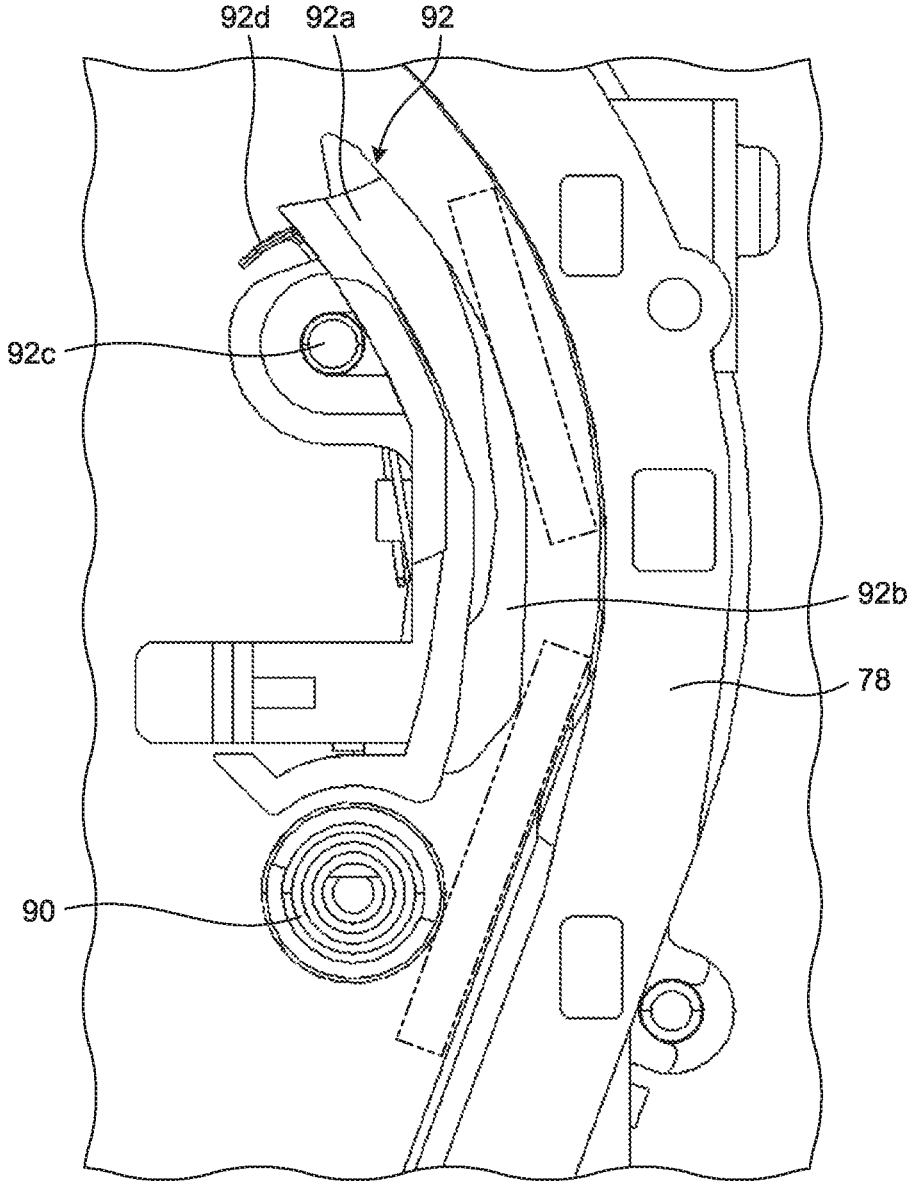
FIG. 37 is an explanatory diagram illustrating an action of the carrier guide illustrated in FIGS. 35 and 36.

Hence, as illustrated in FIG. 37, the guide lever 92*b* can press each coin carried on the third rail forming member 78 by the holding part 81 to the third rail forming member 78, and thus the posture of the coin being carried can be stabilized.

Figure 38:
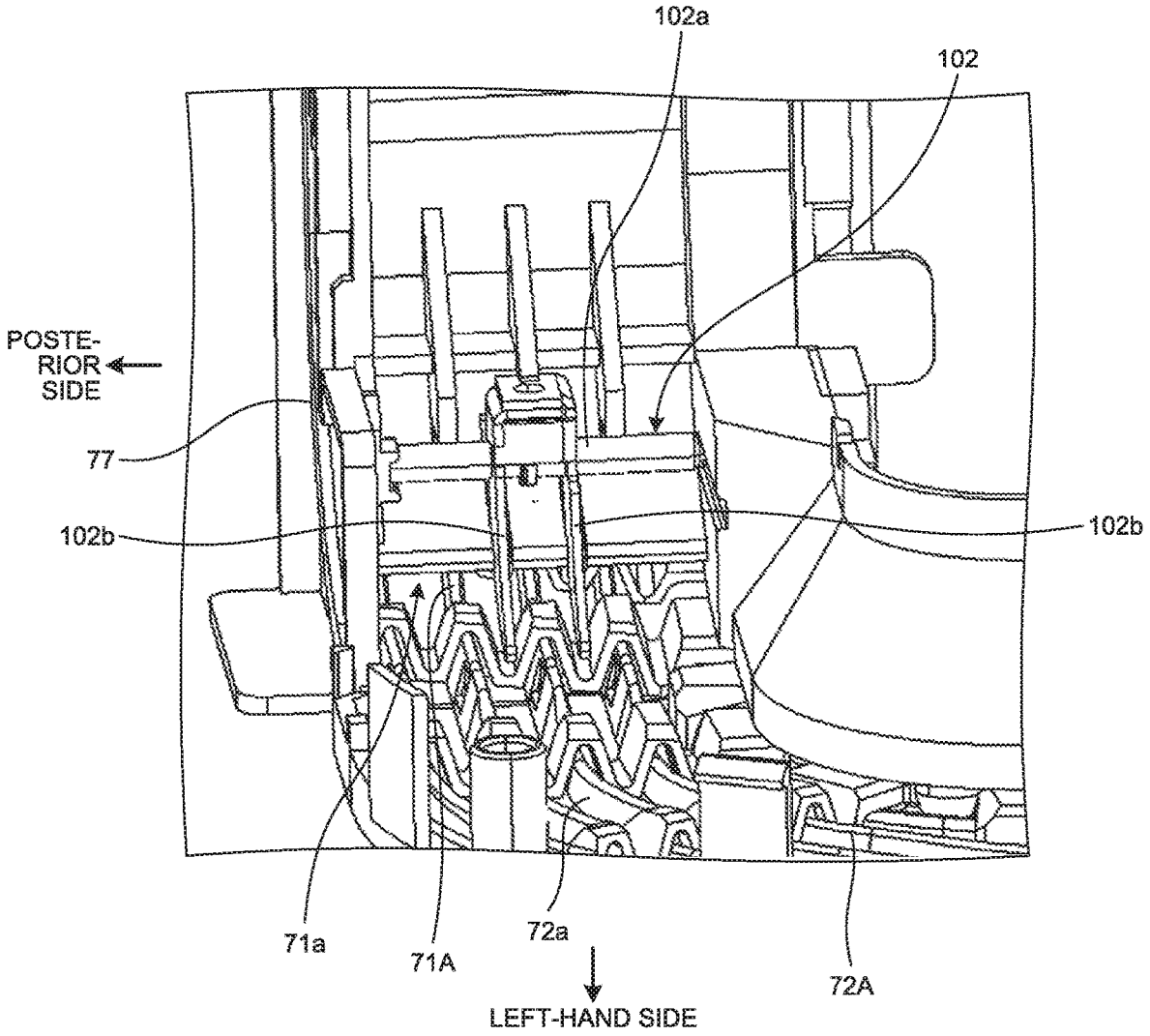
FIG. 38 is an enlarged perspective view illustrating the continuous portion between a curved downward-extending portion of a first rail forming member and a first leftward-extending portion of the second rail forming member.
Figure 39:
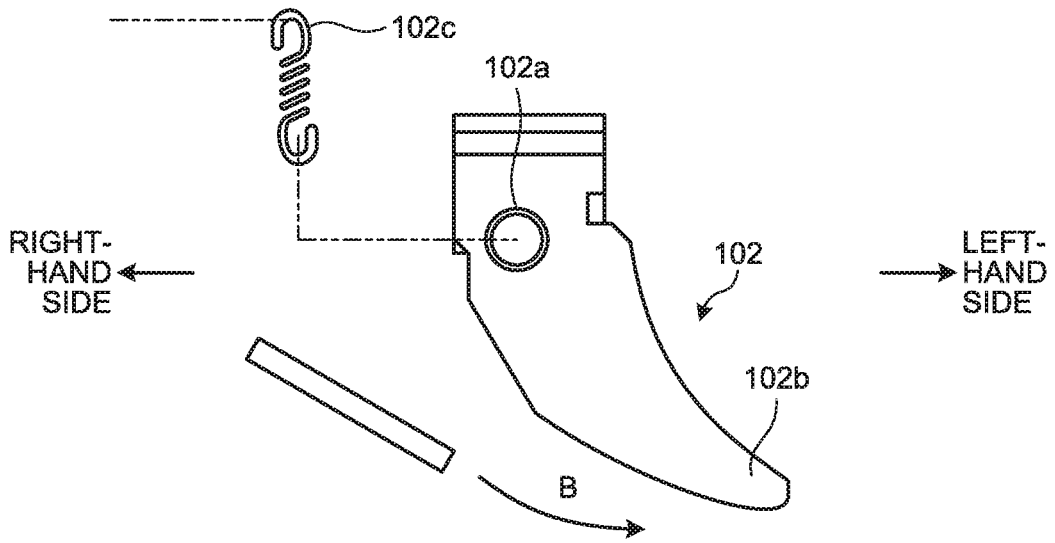
FIG. 39 is a schematic diagram of a passage regulating member of in FIG. 38.

As illustrated in FIG. 38, a passage regulating member 102 is disposed on the second supporting plate 77 and faces the portion connecting the curved downward-extending portion 71*a* of the first rail forming member 71 and the first leftward-extending portion 72*a* of the second rail forming member 72. As illustrated in FIG. 39, the passage regulating member 102 includes a passage regulation shaft 102*a* and passage regulation action portions 102*b* configured in an integrated manner.

The passage regulation shaft 102*a* is a columnar member extending along the front-back direction, and both ends thereof are supported by the second supporting plate 77 in an swingable manner around the central shaft of the passage regulation shaft 102*a*. There are two passage regulation action portions 102*b* representing a pair of anteroposterior regulation action portions. The passage regulation action portions 102*b* are separated from each other and extend toward the outside in a radial direction of the passage regulation shaft 102*a* with reference to the middle area of the passage regulation shaft 102*a*.

The passage regulating member 102 is biased toward the right-hand side by a passage regulation spring 102*c* representing a biasing member, and the leading end of each passage regulation action portion 102*b* makes its way into a passage area B across which the coins are carried by the carrying unit 80.

Figure 40:
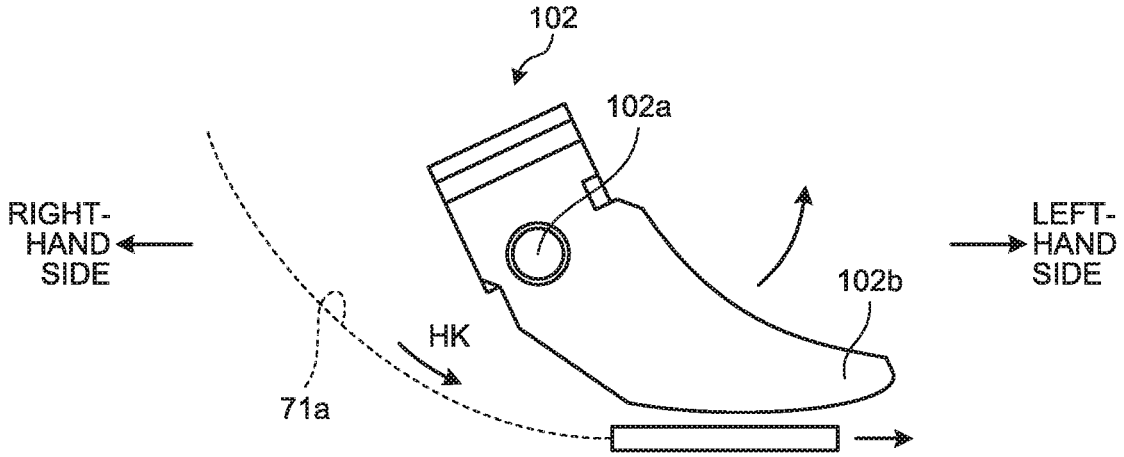
FIG. 40 is a schematic diagram of the passage regulating member of FIG. 38.

When the carrying unit 80 gets displaced in the one direction due to the driving in the forward direction of the carrier drive motor 86; as illustrated in FIG. 40, the passage regulating member 102 abuts against the coin being carried downward in the first rail forming member 71 and swings toward the left-hand side against the biasing force of the passage regulation spring 102*c*, thereby allowing the passage of the coin.

Figure 41:
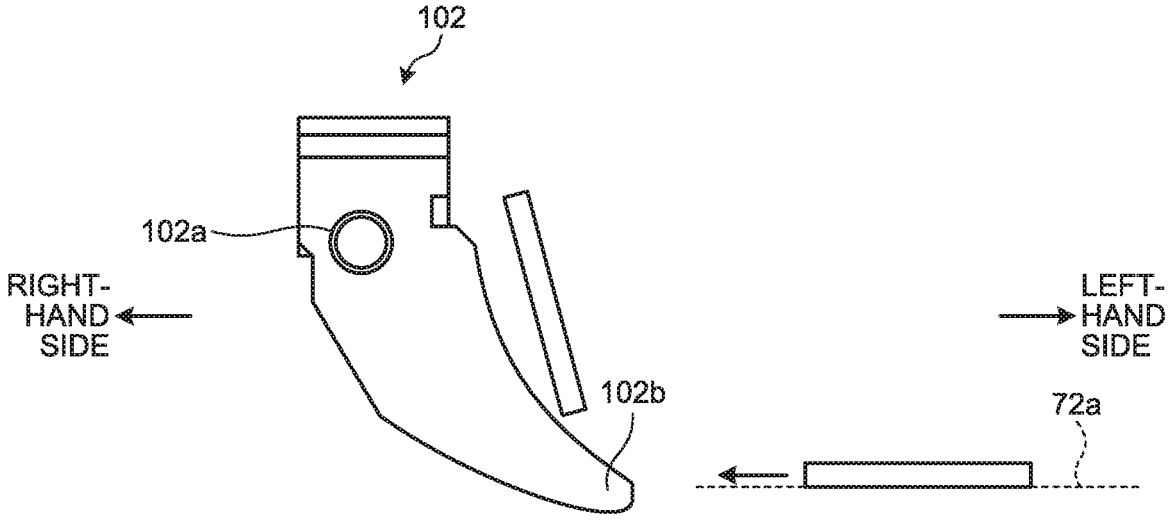
FIG. 41 is a schematic diagram of the passage regulating member of FIG. 38.

On the other hand, when the carrying unit 80 gets displaced in the opposite direction due to the driving in the reverse direction of the carrier drive motor 86; as illustrated in FIG. 41, the passage regulating member 102 separates the coins, which are carried in the opposite direction in the second rail forming member 72 by the carrying unit 80, from the holding parts 81 and regulates the passage of the coins across the curved downward-extending portion 71*a* of the first rail forming member 71.

The discriminating unit 110 is disposed in the fourth rail forming member 74. In a predetermined discrimination area in the fourth rail forming member 74, the discriminating unit 110 identifies the denominations of the coins that are carried while being pressed by the hold-pressing member 82 of the holding parts 81. The discrimination result obtained by the discriminating unit 110 is output as a discrimination signal to the carrying control unit 140.

The returning unit 120 is disposed in the carrying path HK formed by the fourth rail forming member 74, and is disposed on the downstream side of the discriminating unit 110 (the discriminating area). The returning unit 120 includes a returning slot 121 and a returning gate 122.

The returning slot 121 is an opening that is sufficiently large to allow the passage of coins of all denominations carried by the carrying unit 80. The returning slot 121 is connected to the disbursement unit 4.

The returning gate 122 closes the returning slot 121 in the normal state and, when a return instruction is received, swings to open the returning slot 121.

The sorting unit 130 is disposed in the carrying pathway HK formed by the fourth rail forming member 74, and is disposed on the downstream side of the returning unit 120. The sorting unit 130 includes a plurality of sorting passage openings 131 and a plurality of sorting gates 132.

Each sorting passage opening 131 is an opening that is sufficiently large to enable passage of coins. Each sorting gate 132 corresponds to one of the sorting passage openings 131, and is disposed to cut across the carrying pathway HK formed by the fourth rail forming member 74. More specifically, in each sorting gate 132, a plurality of sort sorting gate action pieces 132*b* is disposed at the leading end of a sorting gate shaft 132*a*. Thus, each sorting gate 132 is rotatably supported around the central shaft of the sorting gate shaft 132*a*.

Figure 42:
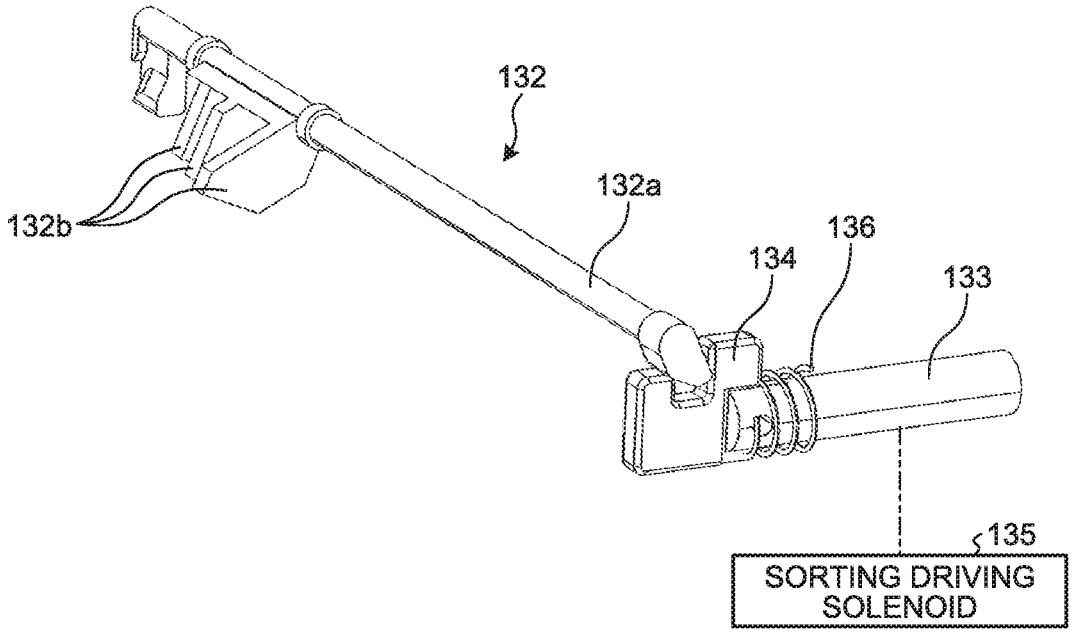
FIG. 42 is a perspective view of a sorting gate illustrated in FIGS. 24 and 25.
Figure 43:
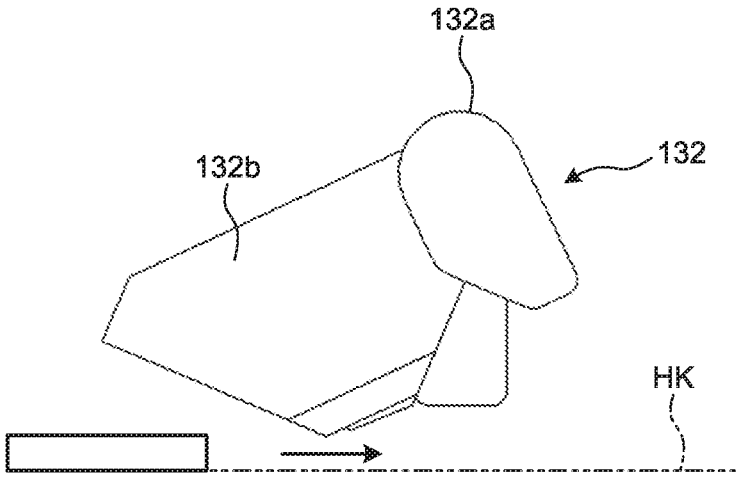
FIG. 43 is a schematic diagram illustrating operations of the sorting gate of FIG. 42.

As illustrated in an enlarged manner in FIG. 42, at the base end portion of the sorting gate haft 132*a*, a locking claw 134 that is disposed at the leading end of a plunger 133 is locked. When a sorting driving solenoid 135 is in a non-conductive state, the plunger 133 uses the biasing force of a spring 136 attached thereto and, as illustrated in FIG. 43, makes the sorting gate action pieces 132*b* separate from the carrying pathway HK for carrying coins.

Figure 44:
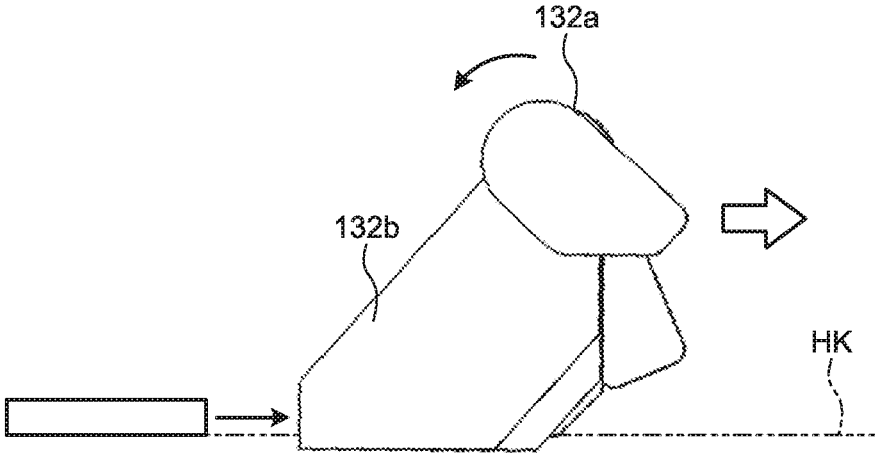
FIG. 44 is a schematic diagram illustrating operations of the sorting gate of FIG. 42.

When the sorting driving solenoid 135 switches to the conductive state in response to a driving instruction received from the carrying control unit 140, the plunger 133 gets drawn by the sorting driving solenoid 135 and, as illustrated in FIG. 44, makes the sorting gate 132 rotate around the central shaft of the sorting gate shaft 132*a* and makes the sorting gate action pieces 132*b* move into the carrying pathway HK.

Figure 45:
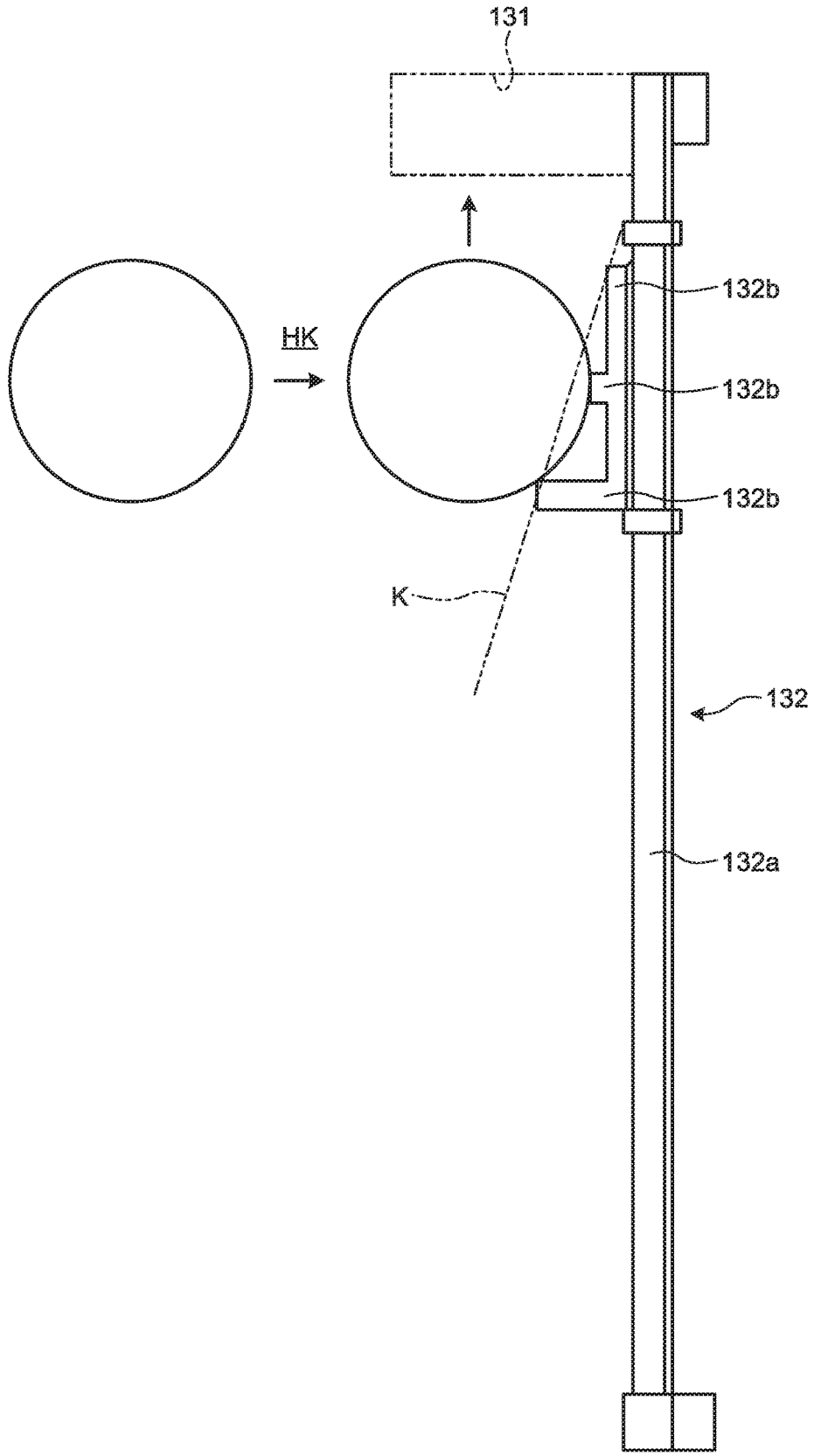
FIG. 45 is a schematic diagram illustrating, when seen from above, operations of the sorting gate of FIG. 42.

As illustrated in FIG. 45, when the sorting gate action pieces 132*b* move into the carrying pathway HK, a tilted portion K, which goes on tilting to the downstream side of the carrying direction as the coins move toward the direction of the sorting passage openings 131, is formed by the end portions of the sorting gate action pieces 132*b*; and each coin carried in the carrying pathway HK can be guided to the predetermined sorting passage opening 131 using the tilted portion K.

The carrying control unit 140 comprehensively controls the operations of the coin carrying device 10*b* according to computer programs and data stored in a memory 141. For example, the carrying control unit 140 can be implemented by making a processor such as a central processing unit (CPU) to execute computer programs, that is, can be implemented using software; or can be implemented using hardware such as an integrated circuit; or can be implemented using a combination of software and hardware.

As described above, the carrying control unit 140 issues a driving instruction to the carrier drive motor 86, and drives the carrier drive motor 86 in the forward direction or the reverse direction. In the case of driving the carrier drive motor 86 in the forward direction, the carrying control unit 140 performs PWM control so as to achieve approximation to a predetermined carrying force.

On the other hand, in the case of driving the carrier drive motor 86 in the reverse direction, the carrying control unit 140 performs control to ensure that the carrying force is greater than the carrying force in the case of driving in the forward direction.

That is, the carrying control unit 140 displaces the carrying unit 80 in such a way that the driving force of displacement in the one direction becomes relatively smaller than the driving force of displacement in the opposite direction.

When a coin discriminated as authentic is carried from the coin validation device 10*a* and when an operation instruction is issued by the coin handling main controller 200 to the carrying control unit 140, the coin carrying device 10*b* having the abovementioned configuration performs operations in the following manner.

That is, the carrying control unit 140 issues a reverse direction driving instruction to the carrier drive motor 86 so that the carrier drive motor 86 is driven in the reverse direction, and displaces the carrying unit 80 in the opposite direction for a predetermined period of time. As a result, the coins that are inserted in the second rail regulating member from the inserting slot 72*d* are carried by the carrying unit 80 in the opposite direction in the second rail forming member 72.

Meanwhile, in the second rail forming member 72, the passage regulating member 102 separates the coins, which are carried in the opposite direction by the carrying unit 80, from the holding parts 81 and regulates the coins from passing across the curved downward-extending portion 71*a* of the first rail forming member 71. Hence, the coins that are inserted from the inserting slot 72*d* can be retained in the second rail forming member 72.

When the predetermined time elapses, the carrying control unit 140 issues a forward direction driving instruction to the carrier drive motor 86 so that the carrier drive motor 86 is driven in the forward direction, and displaces the carrying unit 80 in the one direction. As a result, the coins that are retained in the second rail forming member 72 can be carried in the one direction along the carrying pathway HK.

In each holding part 81 of the carrying unit 80, the inclined surface 82*d* is formed on the pressing face 82*a* that is present in the bottom portion of the first depression 82*b* of the hold-pressing member 82. Hence, when the concerned holding part 81 passes across the curved upward-extending portion 73*a* of the third rail forming member 73, the concerned holding part 81 gets displaced with the rail salient portion 73A of the third rail forming member 73 still being inside the first depression 82*b*, and thus the inclined surface 82*d* becomes positioned away from the rail.

Figure 46:
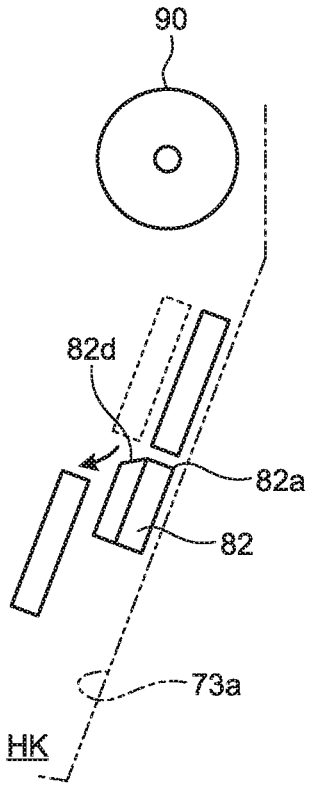
FIG. 46 is an explanatory diagram illustrating an action of a hold-pressing member in the third rail forming member.

For that reason, in the lower area of the reverse roller 90, even if two coins are pressed in a piled manner by the hold-pressing member 82 and are carried in that state, the coins can be separated from the hold-pressing member 82 using the inclined surface 82*d* as illustrated in FIG. 46. As a result, it becomes possible to prevent a situation in which two coins get sandwiched between the reverse roller 90 and the carrying unit 80 thereby leading to clogging of the coins being carried.

Moreover, in the upper area of the reverse roller 90, the guide lever 92*h* of the carrier guide 92 presses each coin, which is carried in the upward direction in the curved upward-extending portion 73*a* of the third rail forming member 73, toward the third rail forming member 73 (the rail portion 70) and thus stabilizes the orientation of that coin being carried. Hence, the coin can be prevented from breaking away from the curved upward-extending portion 73*a* while passing across it.

Furthermore, the upper-end portion 73*a*1 of the curved upward-extending portion 73*a* of the third rail forming member 73 and the right-end portion 74*a*1 of the second leftward-extending portion 74*a* of the fourth rail forming member 74 are facing each other. Thus, in each holding part 81 that passes across the concerned portion, the rail salient portion 73A of the third rail forming member 73 enters the first depression 82*b* in the hold-pressing member 82, and the rail salient portion 74A of the fourth rail forming member 74 enters the second depression 82*c* of the hold-pressing member 82. Hence, the coin that is pressed by the corresponding hold-pressing member 82 gets carried by being sandwiched between the upper-end portion 73*a*1 of the curved upward-extending portion 73*a* and the right-end portion 74*a*1 of the second leftward-extending portion 74*a*, thereby eliminating the risk of the coin breaking away from the carrying pathway HK.

In each holding part 81 that has passed across the third rail forming member 73 in the abovementioned manner, a single coin is held. Then, since the pressing face 82*a* of the hold-pressing member 82 in each holding part 81 of the carrying unit 80 is formed in an inclined manner, the coin can be stably carried while keeping it close to the outside of the carrying pathway HK.

Figure 47:
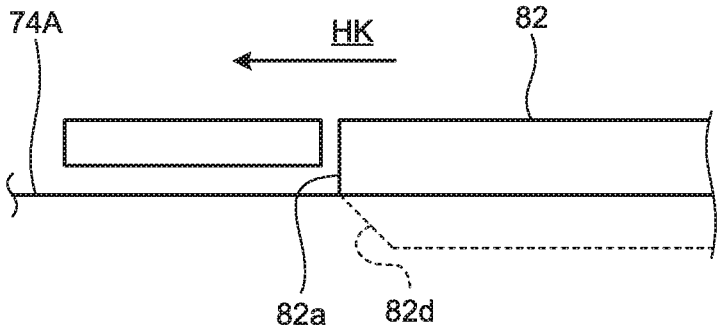
FIG. 47 is an explanatory diagram illustrating an action of the hold-pressing member in the fourth rail forming member.

As described above, in the carrying unit 80, the holding parts 81 that pass across the second rail forming member 72 have the reversed orientation in the vertical direction with respect to the holding parts that pass across the fourth rail forming member 74. As a result, in the case of displacement that occurs when the rail salient portion 74A of the fourth rail forming member 74 is still inside the second depression 82*c*, the inclined surface 82*d* becomes positioned on the lower side of the upper-end portion of the rail salient portion 74A as illustrated in FIG. 47, thereby enabling the hold-pressing member 82 to reliably press the coin and stably carry it.

Subsequently, when the denomination of each coin that is being carried is discriminated by the discriminating unit 110, the carrying control unit 140 issues a driving instruction to the concerned sorting driving solenoid 135 according to the discrimination result, and switches the sorting driving solenoid 135 to the conductive state. As a result, the concerned sorting gate 132 is rotated around the central shaft of the sorting gate shaft 132*a*, and the corresponding sorting gate action piece 132*b* is moved into the carrying path HK. Then, using the tilted portion K that is formed due to the sorting gate action piece 132*b*, the coin can be guided to the corresponding sorting passage opening 131 and can be stored in the coin container 5.

Meanwhile, if the denomination of a coin is not discriminated by the discriminating unit 110, then the carrying control unit 140 does not issue a driving instruction to any sorting driving solenoid 135. In that case, the sorting gate action pieces 132*b* in all sorting gates 132 break away from the carrying pathway HK. Hence, the coin that has passed across the fourth rail forming member 74 goes on to pass across the first rail forming member 71, reaches the second rail forming member 72, again passes across the carrying pathway HK, and is again subjected to discrimination by the discriminating unit 110.

Within a predetermined period of operations, when all coins that have been carried in the carrying pathway HK are stored according to their denominations in the coin container 5, the carrying control unit 140 issues a driving termination instruction to the carrier drive motor 86 and makes the carrier drive motor 86 terminate operations; and then sends a signal indicating the completion of the carrying of coins to the coin handling main controller 200.

On the other hand, if the period of operations elapses with some coins still left in the carrying pathway HK, the carrying control unit 140 issues a returning instruction to the returning gate 122 so as to make the returning gate 122 open the returning slot 121; guides the coins that are being carried in the carrying pathway HK to the returning slot 121 and delivers them to the disbursement unit 4; and makes the disbursement unit 4 drive out the coins to the outside.

As described above, in the coin carrying device 10*b*; the carrying unit 80, which is configured by interlinking in an endless manner the holding parts 81 that are capable of holding one coin at a time, gets displaced in the one direction along the rail portion 70 that constitutes a predetermined carrying pathway HK including the curved upward-extending portion 73*a* (the ascending portion) which is curved upward. As a result, the coins that are deposited are carried from the downward side toward the upward side. Hence, as compared to a conventional case in which the coins are carried by a plurality of belts stretched in an endless manner around a pair of rollers, the installation area of the coin handling machine 1 can be reduced and downsizing thereof can be achieved.

Besides, the carrier guide 92 stabilizes the orientation of the coins being carried, which are carried upward in the curved upward-extending portion 73*a* of the third rail forming member 73, by pressing the coins toward the third rail forming member 73 (the rail portion 70). Hence, the coins can be prevented from braking away from the curved upward-extending portion 73*a* while passing across it. That enables achieving prevention of clogging of the coins being carried.

Moreover, in the coin carrying device 10*b*, when a coin is inserted into the carrying unit 80, the carrying control unit 140 displaces the carrying unit 80 in the opposite direction for a predetermined period of time and, after the predetermined period of time elapses, displaces the carrying unit 80 in the one direction. Hence, the coin inserted into the inserting slot 72*d* can be retained in the second rail forming member 72. As a result, a large number of coins can be accepted from the coin validation device 10*a*.

Furthermore, in the coin carrying device 10*b*, the carrying control unit 140 displaces the carrying unit 80 in such a way that the driving force of displacement in the one direction becomes relatively smaller than the driving force of displacement in the opposite direction. Hence, even if some malfunctioning happens at the time of carrying the coins along the carrying pathway HK and leads to clogging of the coins, the carrier drive motor 86 can be driven in the reverse direction and the carrying unit 80 can be displaced in the opposite direction so that the force for unclogging of the coins can be set to be greater than the force at the time of clogging of the coins. Hence, the clogging of the coins can be resolved.

Moreover, in the coin carrying device 10*b*, the fourth rail forming member 74 can swing in the vertical direction around the central shaft of the first projecting portion 75*a* and the second projecting portion 75*b*. Hence, in case clogging of the coins occurs in the second rail forming member 72, the fourth rail forming member 74 can be swung upward and the coins responsible for the clogging can be easily taken out from the second rail forming member 72.

Although, the explanation herein is given about a preferred embodiment of the present disclosure, the present disclosure is not limited to that embodiment and it is possible to have various modifications.

In the embodiment described above, the validation control unit 60 and the carrying control unit 140 are configured as separate units. However, alternatively, in the present disclosure, the validation control unit 60 and the carrying control unit 140 can be configured in an integrated manner with the coin handling main controller 200.

Moreover, although not particularly explained In the embodiment described above, in the present disclosure, the curved portion from the second leftward-extending portion 74*a* up to the rearward-extending portion 74*b* of the fourth rail forming member 74 and the curved portion from the rearward-extending portion 74*b* up to the second rightward-extending portion 74*c* of the fourth rail forming member 74 can be configured in such a way that the projection height of the rail salient portion 74A gradually decreases as it moves to the outward side. With that, the passing coins can be kept close to the outside of the carrying pathway HK.

Furthermore, in the present disclosure, on the outside portion of the curved portion from the first leftward-extending portion 72*a* up to the anterior-extending portion 72*b* of the second rail forming member 72 or on the outside portion of the curved portion from the anterior-extending portion 72*b* up to the first rightward-extending portion 72*c* of the second rail forming member 72, a space for accumulating the coins can be provided.

Figure 48:
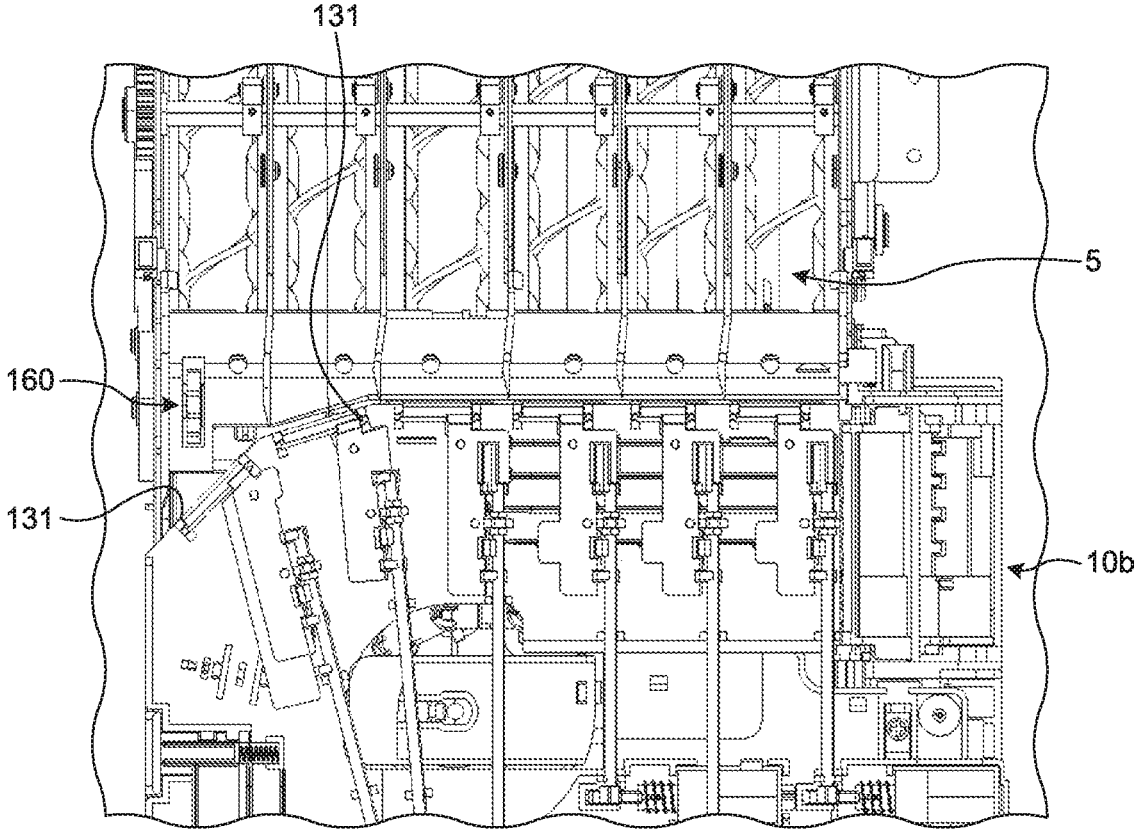
FIG. 48 is a planar view illustrating main components of a modification of the coin validation device of FIG. 24.

Moreover, in the present disclosure, as illustrated in FIG. 48, for example, a carrier roller 160 with blades may be disposed on a path from the sorting passage openings 131 to the coin container 5 in a rotatable manner as appropriate. By disposing the carrier roller 160, coins can be prevented from stagnating in the path between the sorting passage openings 131 and the coin container 5.

According to the present disclosure, regarding a coin that is identified to be a counterfeit coin by a discriminator, a carrying unit that carries the inserted coins in the horizontally-fallen state in one direction carries the counterfeit coin in another direction opposite to the one direction. Hence, the carrying length required in the carrying unit can be shortened, thereby enabling achieving downsizing of the coin handling machine 1.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A coin validation device that is implemented in a coin handling machine which stores therein a deposited coin on a denomination-by-denomination basis and which pays out stored coin in response to a disbursement instruction, the coin validation device comprising:

a carrier that carries the deposited coin in a horizontally-fallen state in one direction; and a discriminator that identifies authenticity and denominations of the coin carried in the one direction by the carrier, wherein the carrier carries a coin, which is discriminated as a counterfeit coin by the discriminator, in another direction opposite to the one direction, and the carrier includes carrier pulleys that are provided as a pair of pulleys, a pair of left and right carrier belts, each being stretched in an endless manner between the carrier pulleys, and a plurality of carrying members, each having left and right ends attached to the left and right carrier belts, respectively, each being configured to carry the deposited coin in the horizontally-fallen state toward a posterior side according to displacement of the left and right carrier belts and carry the coin, which is discriminated as the counterfeit coin by the discriminator, in the horizontally-fallen state toward an anterior side.

2. The coin validation device according to claim 1, wherein a face of each of the carrying members that presses a target coin for carrying according to the displacement of the carrier belts is in a V-shape.

3. The coin validation device according to claim 1, further comprising a delivery flapper that is provided in a manner to open and close a delivery opening formed in vicinity of the discriminator, that closes the delivery opening in a normal state, and that, when a coin is discriminated as authentic by the discriminator, opens the delivery opening and allows passage of the coin, which is carried in the one direction by the carrier, through the delivery opening.

4. A coin validation device that is implemented in a coin handling machine which stores therein a deposited coin on a denomination-by-denomination basis and which pays out stored coin in response to a disbursement instruction, the coin validation device comprising:

a carrier that carries the deposited coin in a horizontally-fallen state in one direction;

a discriminator that identifies authenticity and denominations of the coin carried in the one direction by the carrier;

a delivery flapper that is provided in a manner to open and close a delivery opening formed in vicinity of the discriminator, that closes the delivery opening in a normal state, and that, when a coin is discriminated as authentic by the discriminator, opens the delivery opening and allows passage of the coin, which is carried in the one direction by the carrier, through the delivery opening; and a guiding member that is disposed to be able to move in and out of a passage area of a coin to be carried in the one direction by the carrier with orientation posture for moving in the passage area, in the normal state, that, when the delivery flapper closes the delivery opening, moves out from the passage area by a pressure from a coin passing across the passage area, and thus allows passage of the coin, and that, when the delivery flapper opens the delivery opening, is in contact with a coin passing through the passage area and guides the coin to the delivery opening, wherein the carrier carries a coin, which is discriminated as a counterfeit coin by the discriminator, in another direction opposite to the one direction, and the carrier includes carrier pulleys that are provided as a pair of pulleys, a carrier belt that is stretched in an endless manner between the carrier pulleys, and a number of the carrier belt is one.

5. A coin validation device that is implemented in a coin handling machine which stores therein a deposited coin on a denomination-by-denomination basis and which pays out stored coin in response to a disbursement instruction, the coin validation device comprising:

a carrier that carries the deposited coin in a horizontally-fallen state in one direction; and a discriminator that identifies authenticity and denominations of the coin carried in the one direction by the carrier, wherein the carrier carries a coin, which is discriminated as a counterfeit coin by the discriminator, in another direction opposite to the one direction, the carrier includes carrier pulleys that are provided as a pair of pulleys, a carrier belt that is stretched in an endless manner between the carrier pulleys, and a number of the carrier belt is one, the carrier carries, when the carrier drives in a forward driving direction, the deposited coin in the horizontally-fallen state toward a posterior side and carries the coin, which is discriminated as the counterfeit coin by the discriminator, in the horizontally-fallen state toward an anterior side, the carrier carries, when the carrier drives in a reverse driving direction, the deposited coin in the horizontally-fallen state toward the anterior side and carries the coin, which is discriminated as the counterfeit coin by the discriminator, in the horizontally-fallen state toward the posterior side, and the coin validation device includes a temporarily retaining mechanism that temporarily retains the coin which is discriminated as the counterfeit coin by the discriminator when the carrier drives in the reverse driving direction.

* * * * *